US011027541B2

(12) United States Patent
Yoda

(10) Patent No.: US 11,027,541 B2
(45) Date of Patent: Jun. 8, 2021

(54) LIQUID DISCHARGE APPARATUS

(71) Applicant: Kazuhisa Yoda, Kanagawa (JP)

(72) Inventor: Kazuhisa Yoda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/804,013

(22) Filed: Feb. 28, 2020

(65) Prior Publication Data

US 2020/0290342 A1 Sep. 17, 2020

(30) Foreign Application Priority Data

Mar. 14, 2019 (JP) ..... JP2019-047647
Jan. 8, 2020 (JP) ..... JP2020-001493

(51) Int. Cl.
*B41J 2/045* (2006.01)
*B41J 2/175* (2006.01)
*B41J 2/14* (2006.01)
*B41J 2/165* (2006.01)

(52) U.S. Cl.
CPC ..... *B41J 2/04501* (2013.01); *B41J 2/14* (2013.01); *B41J 2/16505* (2013.01); *B41J 2/16585* (2013.01); *B41J 2/17513* (2013.01); *B41J 2002/14362* (2013.01); *B41J 2002/14491* (2013.01)

(58) Field of Classification Search
CPC ... B41J 2/14; B41J 2/2056; B41J 2/195; B41J 2/2142; B41J 2/2139; B41J 2/2146; B41J 2/16505; B41J 2/16585; H04N 1/4078; G06K 15/027
USPC ..... 347/47
See application file for complete search history.

(56) References Cited

U.S. PATENT DOCUMENTS 5,731,826 A * 3/1998 Hirano ..... B41J 2/16579 310/320
2006/0114286 A1* 6/2006 Na ..... B41J 2/16585 347/33
2007/0076046 A1* 4/2007 Toki ..... B41J 2/185 347/31
2008/0238993 A1* 10/2008 Gomez ..... B41J 11/04 347/36
2010/0194820 A1* 8/2010 Usuda ..... B41J 11/0065 347/31
2012/0154484 A1* 6/2012 Hashimoto ..... B41J 2/16523 347/31

(Continued)

FOREIGN PATENT DOCUMENTS

JP 2000-127439 5/2000
JP 2017-087719 5/2017
JP 2017-205956 11/2017

*Primary Examiner* — Huan H Tran
*Assistant Examiner* — Alexander D Shenderov
(74) *Attorney, Agent, or Firm* — Xsensus LLP

(57) ABSTRACT

A liquid discharge apparatus includes a head configured to discharge a liquid, a liquid receptacle configured to receive the liquid discharged from the head, a moving device configured to move the liquid receptacle relative to the head, and control circuitry. The liquid receptacle includes an absorber and an absorber case configured to house the absorber. The absorber includes a slit. The control circuitry is configured to cause the head to discharge the liquid into the slit of the absorber while moving, with the moving device, the liquid receptacle with respect to the head.

15 Claims, 21 Drawing Sheets

(56) References Cited

U.S. PATENT DOCUMENTS

2019/0329555 A1 10/2019 Yoda

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-047647, filed on Mar. 14, 2019, and 2020-001493, filed on Jan. 8, 2020, in the Japan Patent Office, the entire disclosure of each of which is hereby incorporated by reference herein.

BACKGROUND

Technical Field

The present disclosure relates to a liquid discharge apparatus.

Related Art

Apparatuses including a liquid discharge head discharge liquid that does not contribute to liquid application to a target (a medium such as a sheet), for maintenance and recovery of the liquid discharge head. The liquid not contributing to liquid application is discharged toward, for example, a liquid receptacle. Such an operation is called dummy discharge (also called flushing or purging).

SUMMARY

According to an embodiment of this disclosure, a liquid discharge apparatus includes a head configured to discharge a liquid, a liquid receptacle configured to receive the liquid discharged from the head, a moving device configured to move the liquid receptacle relative to the head, and control circuitry. The liquid receptacle includes an absorber and an absorber case configured to house the absorber. The absorber includes a slit. The control circuitry is configured to cause the head to discharge the liquid into the slit of the absorber while moving, with the moving device, the liquid receptacle with respect to the head.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
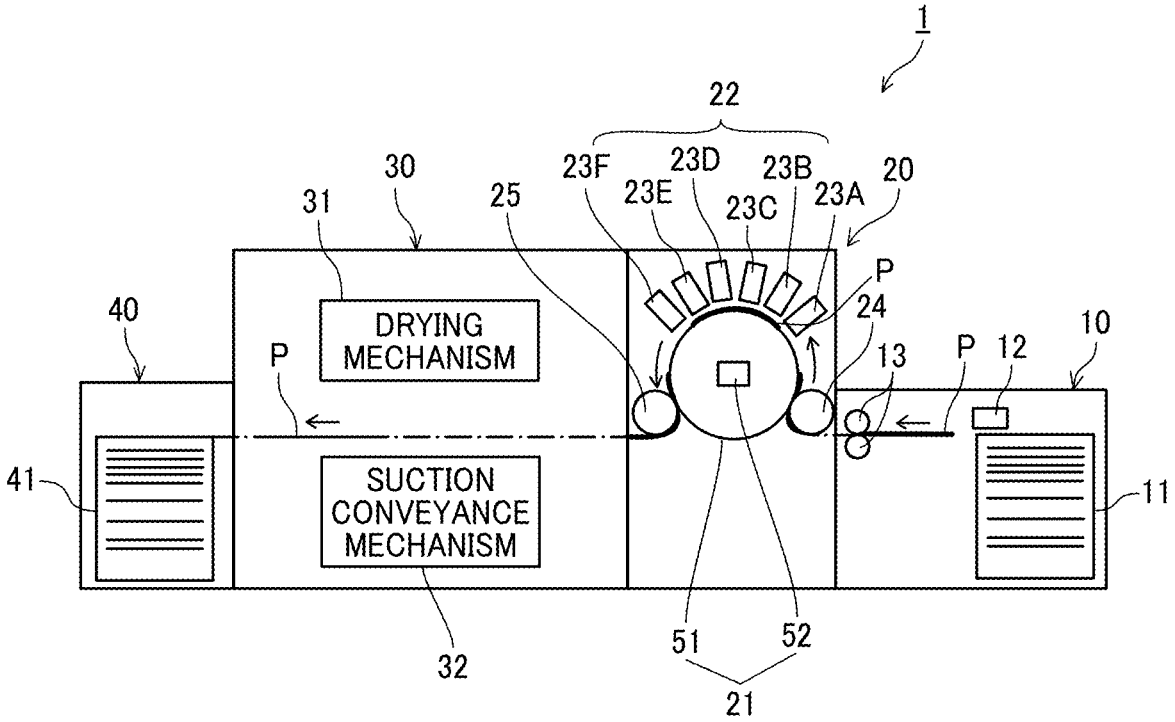
FIG. 1 is a schematic view of a printer that is a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

Figure 2:
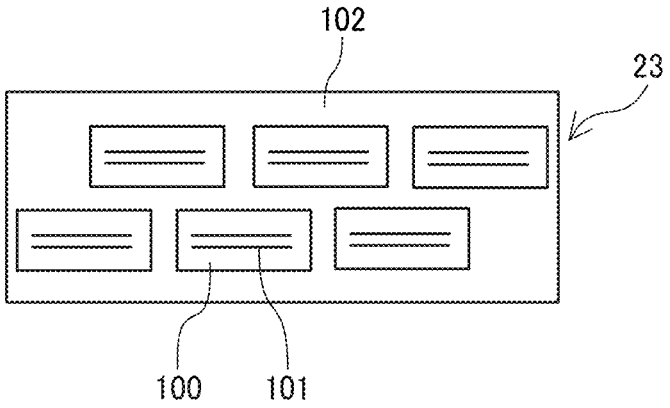
FIG. 2 is a plan view of an example of a liquid discharge unit of the printer illustrated in FIG. 1.
Figure 3:
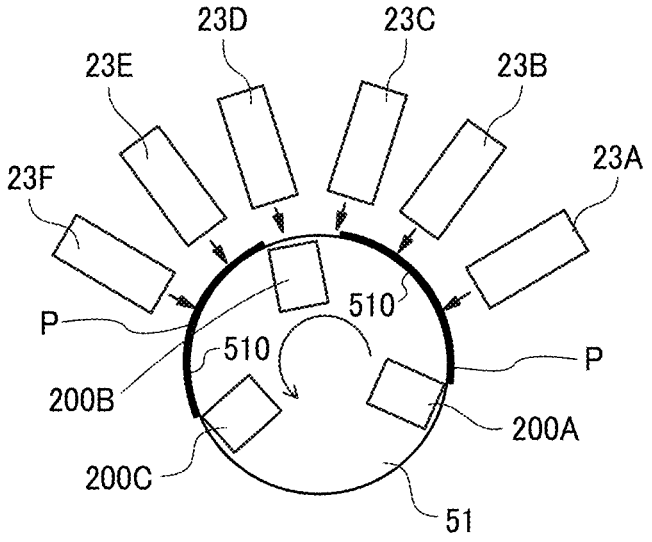
FIG. 3 is a diagram illustrating an arrangement of liquid receptacles of the printer illustrated in FIG. 1.

A first embodiment of the present disclosure is described with reference to FIGS. 1 to 3. FIG. 1 is a schematic view of a printer as the liquid discharge apparatus according to the first embodiment. FIG. 2 is a plan view of an example of a liquid discharge unit of the printer illustrated in FIG. 1. FIG. 3 is a diagram illustrating an arrangement of liquid receptacles of the printer.

A printer 1 includes a loading unit 10, a printing unit 20, a drying unit 30, and an unloading unit 40. The printer 1 applies, with the printing unit 20, a liquid onto a sheet P conveyed from the loading unit 10, to perform required printing. Thereafter, the printer 1 dries the liquid applied to the sheet P in the drying unit 30 and ejects the sheet P to the unloading unit 40.

The loading unit 10 includes a loading tray 11, a feeder 12, and a registration roller pair 13. A plurality of sheets P is stacked on the loading tray 11. The feeder 12 separates and feeds the sheets P from the loading tray 11 one by one. The registration roller pair 13 sends the sheet P fed by the feeder 12 to the printing unit 20.

The feeder 12 can be any feeding device such as a device using a roller or a roll, or a device using air suction. After the leading end of the sheet P sent out from the loading tray 11 by the feeder 12 reaches the registration roller pair 13, the registration roller pair 13 is driven at a predetermined timing, to send the sheet P to the printing unit 20.

The printing unit 20 includes a sheet conveyor 21 that conveys the sheet P. The sheet conveyor 21 includes a drum 51, a suction device 52, and the like. The drum 51 is a medium bearer (a rotator) that bears the sheet P on a peripheral face thereof and rotates. The suction device 52 generates a suction force on the peripheral face of the drum 51.

The printing unit 20 includes a liquid discharge device 22 that discharges a liquid toward the sheet P carried on the drum 51 of the sheet conveyor 21.

The printing unit 20 includes a transfer cylinder 24 that receives the sheet P and forwards the sheet P to the drum 51 and a transfer cylinder 25 that forwards the sheet P conveyed by the drum 51 to the drying unit 30.

The transfer cylinder 24 includes a sheet griper to grip the leading end of the sheet P conveyed from the loading unit 10 to the printing unit 20. The sheet P thus gripped is conveyed as the transfer cylinder 24 rotates. The transfer cylinder 24 forwards the sheet P to the drum 51 at a position opposite the drum 51.

Similarly, the drum 51 includes a sheet gripper on the surface thereof, and the leading end of the sheet P is gripped by the sheet gripper. The drum 51 includes a plurality of suction holes dispersed on the surface thereof. The suction device 52 generates suction airflows orienting inward from the suction holes of the drum 51.

On the drum 51, the sheet gripper grips the leading end of the sheet P forwarded from the transfer cylinder 24, and the sheet P is attracted to and carried on the drum 51 by the suction airflows by the suction device 52. As the drum 51 rotates, the sheet P is conveyed.

The liquid discharge device 22 includes discharge units 23 (23A to 23F) that discharge liquids. For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively. Further, the discharge units 23E and 23F are used to discharge the liquid of any one of Y, M, C, and K or special liquid such as white and gold (silver). Furthermore, a discharge unit that discharges a treatment liquid such as a surface coating liquid may be provided.

The discharge unit 23 is a full line head and includes a plurality of liquid discharge heads 100 (hereinafter simply referred to as "heads 100") arranged on a base 102. The liquid discharge head 100 includes nozzle rows 101 including a plurality of nozzles. The nozzles are arranged, for example, as illustrated in FIG. 2.

The discharge operation of each discharge unit 23 of the liquid discharge device 22 is controlled by a drive signal corresponding to print data. When the sheet P carried on the drum 51 passes through a region facing the liquid discharge device 22, the respective color liquids are discharged from the discharge units 23, and an image corresponding to the print data is formed.

A plurality of liquid receptacles 200 (200A, 200B, and 200C) is arranged at substantially equal angular intervals in the drum 51 of the sheet conveyor 21. In the present embodiment, the drum 51 is provided with the three liquid receptacles 200A, 200B, and 200C. The liquid receptacles 200 are embedded in recesses on the peripheral face of the drum 51. The peripheral face of the drum 51 includes a plurality of sheet conveyance faces 510 at positions different from the liquid receptacles 200 in the direction in which the liquid receptacles 200 move relative to the liquid discharge heads 100. The sheet conveyance faces 510 carry the sheets P, respectively.

When performing maintenance of the heads 100 of the discharge unit 23, a liquid (dummy discharge droplet) not applied to the sheet P is discharged to the liquid receptacle 200, which is called "dummy discharge operation."

The drying unit 30 includes a drying mechanism 31 and a suction conveyance mechanism 32. The drying mechanism 31 dries the liquid applied on the sheet P in the printing unit 20. The suction conveyance mechanism 32 conveys the sheet P conveyed from the printing unit 20 while sucking the sheet P.

The sheet P conveyed from the printing unit 20 is received by the suction conveyance mechanism 32, conveyed passing through the drying mechanism 31, and forwarded to the unloading unit 40.

When the sheet P passes through the drying mechanism 31, the liquid on the sheet P is dried. As a result, a liquid component such as moisture in the liquid evaporates, and the colorant contained in the liquid is fixed on the sheet P. Additionally, curling of the sheet P is inhibited.

The unloading unit 40 includes an unloading tray 41 on which a plurality of sheets P is stacked. The sheets P conveyed from the drying unit 30 are sequentially stacked and held on the unloading tray 41.

The printer 1 can further include, for example, a pretreatment unit disposed upstream from the printing unit 20, or a post-processing unit (a finisher) disposed between the drying unit 30 and the unloading unit 40. The pretreatment unit performs pretreatment on the sheet P. The post-processing unit performs post-processing of the sheet P to which the liquid is applied.

For example, the pretreatment unit coats the sheet P with a treatment liquid that reacts with the liquid to inhibit bleeding (a pre-coating process). For example, the post-processing unit turns upside down the sheet printed by the printing unit 20 and again sends the sheet to the printing unit 20 for performing printing on both sides of the sheet (a sheet reversal conveyance process). Alternatively, the post-processing unit can bind together a plurality of sheets.

Although the printer to perform printing on cut sheets P is described as the liquid discharge apparatus, aspects of this disclosure are applicable to a printer or the like to perform printing on a continuous medium, such as continuous paper.

Figure 4:
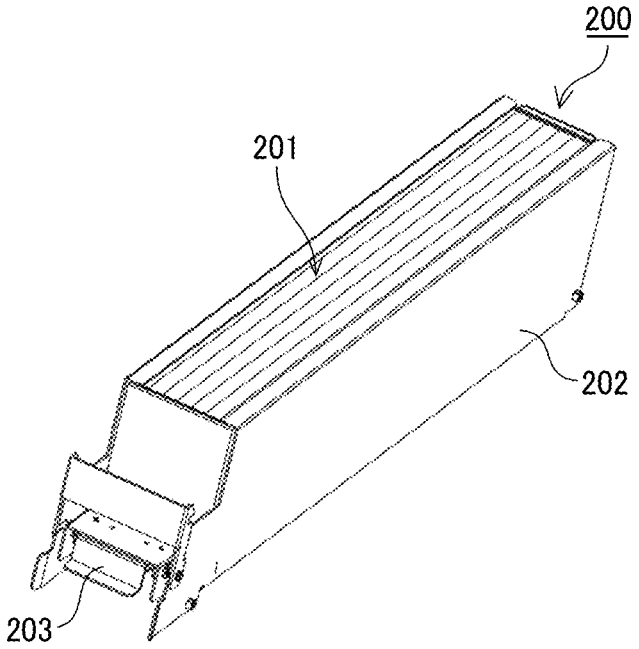
FIG. 4 is an exterior perspective view of a liquid receptacle according to a first embodiment.

Next, the liquid receptacle according to the first embodiment is described with reference to FIGS. 4 and 5. FIG. 4 is an exterior perspective view of the liquid receptacle. FIGS. 5A to 5C are perspective views illustrating a replacement procedure of a liquid receiver of the liquid receptacle.

The liquid receptacle 200 includes a liquid receiver 201 and a support case 202. The liquid receiver 201 receives the liquid discharged from the head 100. The support case 202 is a support that supports the liquid receiver 201 on the drum 51.

The support case 202 includes a slide rail 203 on the bottom face thereof. The slide rail 203 detachably supports the liquid receiver 201 and is movable in the axial direction of the drum 51.

Then, when a receiver-full detector detects that the liquid receiver 201 is full, a user can pull out the liquid receiver 201 from the support case 202 for replacement.

Figure 5A:
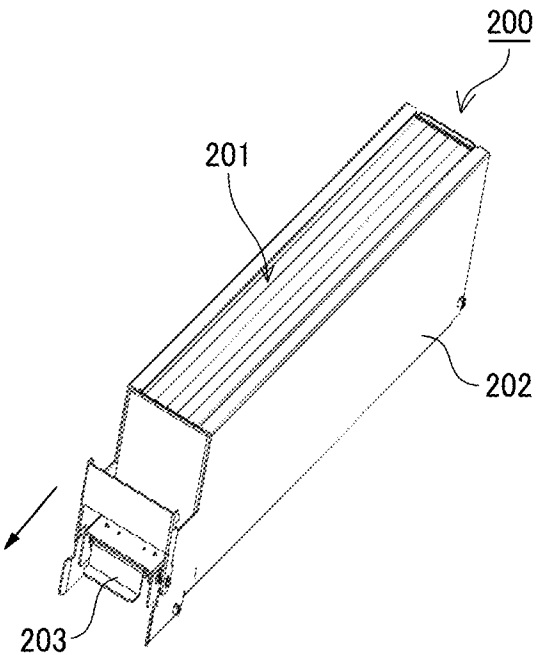
FIGS. 5A to 5C are perspective views illustrating a replacement procedure of a liquid receiver of the liquid receptacle.
Figure 5B:
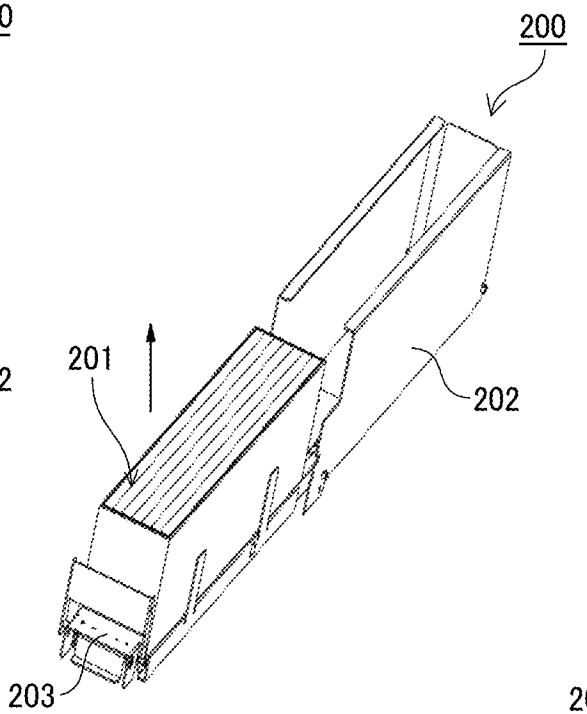
Figure 5C:
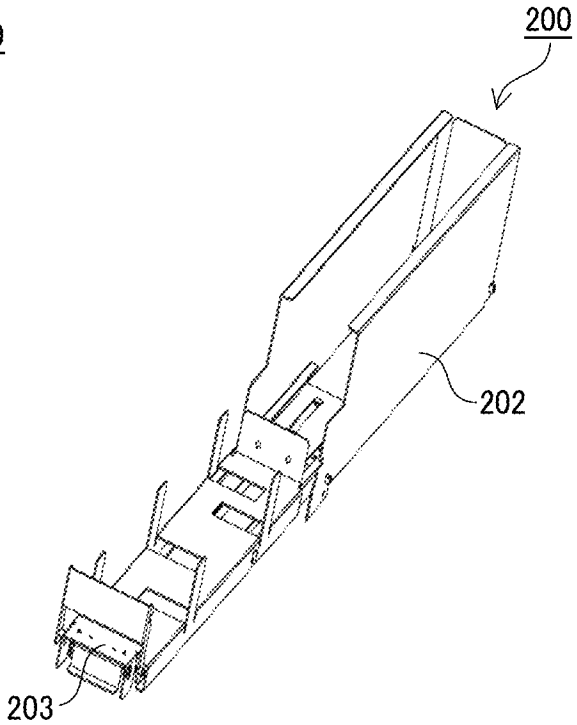

In the replacement of the liquid receiver 201, the slide rail 203 is pulled out in the direction indicated by the arrow illustrated in FIG. 5A to the position illustrated in FIG. 5B. Next, as illustrated in FIG. 5B, the used liquid receiver 201 is pulled out in the direction indicated by the arrow illustrated in FIG. 5B, and the slide rail 203 is emptied as illustrated in FIG. 5C. Thereafter, a new liquid receiver 201 is set on the slide rail 203, and the slide rail 203 is returned inside the support case 202 as illustrated in FIG. 4.

As described above, since the liquid receiver 201 alone is replaceable, the number of replacement parts can be reduced, and cost can be reduced. However, the liquid receptacle 200 can be constructed only of the liquid receiver 201.

Figure 6:
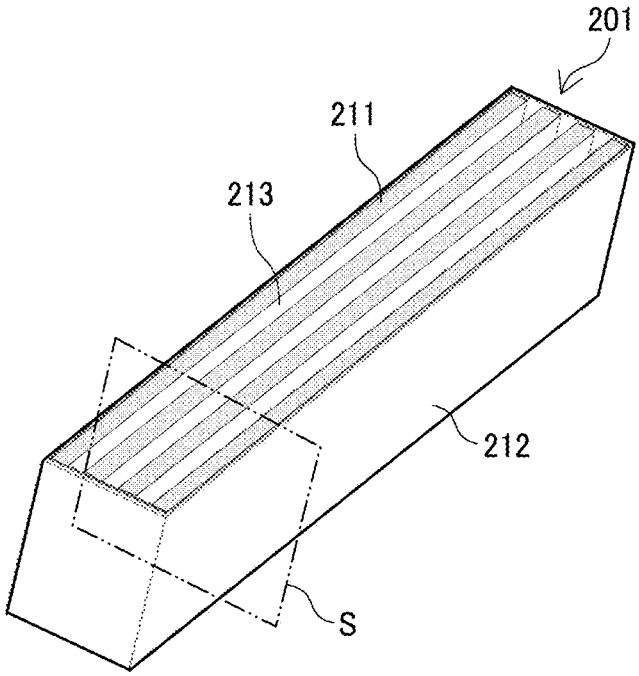
FIG. 6 is a perspective view illustrating the liquid receiver of the liquid receptacle.
Figure 7:
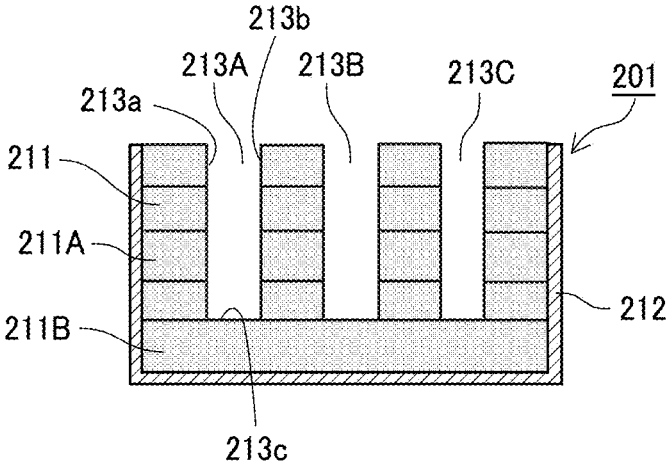
FIG. 7 is a cross-sectional view (in a plane S in FIG. 6) of the liquid receiver taken along a short-side direction.
Figure 8:
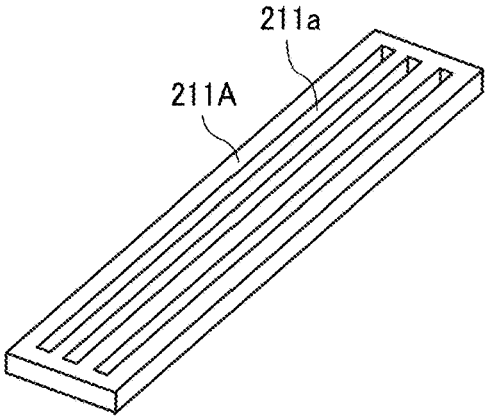
FIG. 8 is a perspective view illustrating an example of an absorbing member of the liquid receiver.

Next, the liquid receiver of the liquid receptacle is described with reference to FIGS. 6 to 8. FIG. 6 is an exterior perspective view of the liquid receptacle. FIG. 7 is a cross-sectional view (in a plane S in FIG. 6) of the liquid receiver taken along a short-side direction (lateral direction) thereof. FIG. 8 is an exterior perspective view illustrating an example of an absorbing member of the liquid receptacle.

The liquid receiver 201 includes an absorber 211 and an absorber case 212 that houses the absorber 211.

The absorber 211 includes slits 213 extending along the longitudinal direction thereof. The longitudinal direction of the absorber 211 coincides with the axial direction of the drum 51 and is orthogonal to the conveyance direction of the sheet. The number of slits 213 can be one or more. In the present embodiment, three slits 213 (213A to 213C) are arranged side by side in the conveyance direction.

The absorber 211 includes a plurality of laminated absorbing members 211A and a flat absorbing member 211B. Each absorbing member 211A includes through grooves 211*a* to form the slit 213. The absorbing member 211B is plate-shaped and disposed on the bottom face of the absorber case 212. Then, the absorbing member 211B and the plurality of absorbing members 211A are sequentially stacked in this order from the bottom face of the absorber case 212.

The absorber case 212 is made of, for example, a resin having no liquid permeability.

As illustrated in FIG. 8, regarding the shape of the through groove 211*a* forming the slit 213, the end of the through groove 211*a* in the longitudinal direction of the absorbing member 211A can be either closed or open, that is, not closed.

Figure 9:
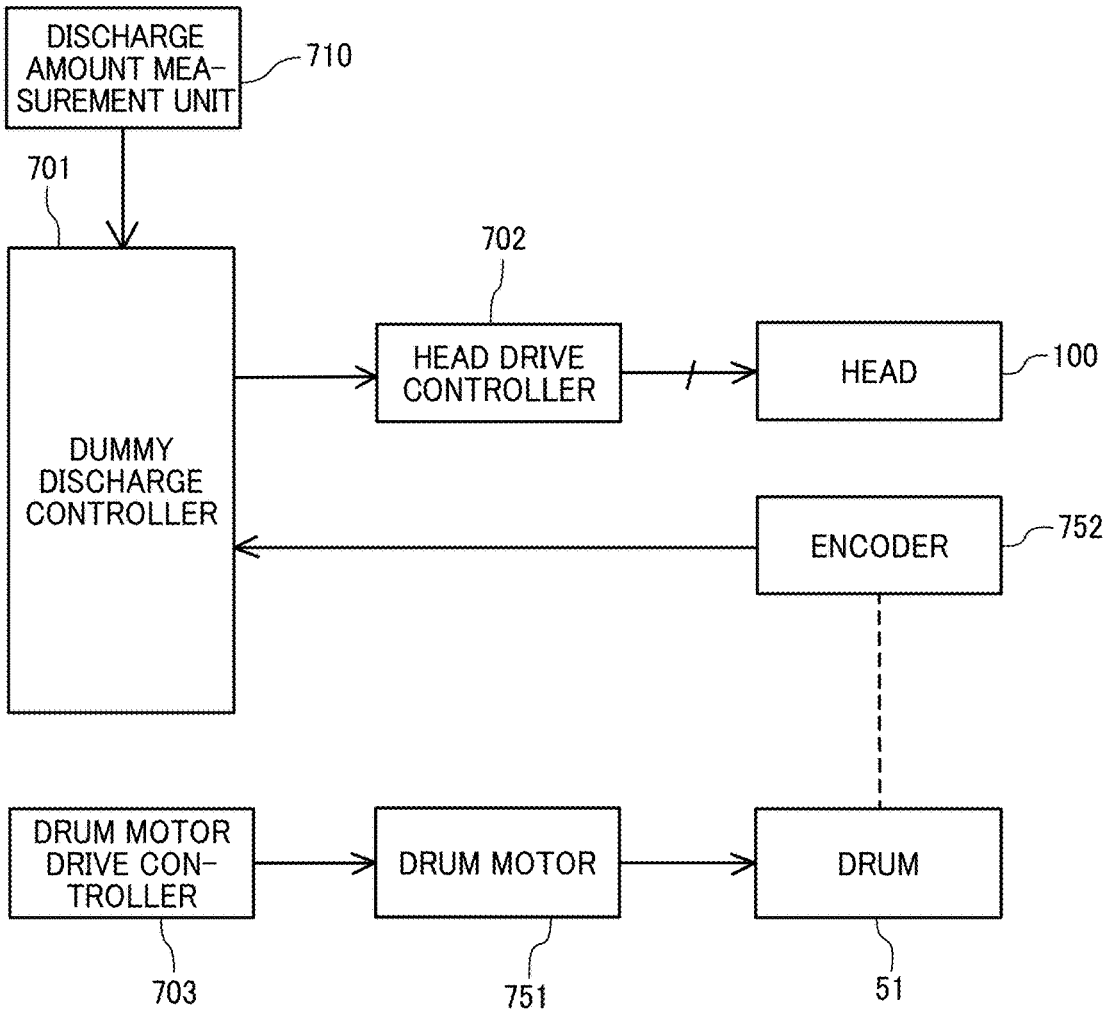
FIG. 9 is a block diagram illustrating a portion related to control of dummy discharge operation to the liquid receptacle (liquid receiver) according to the first embodiment.

Next, a description is given of control of the dummy discharge operation to the liquid receptacle (liquid receiver) in the first embodiment, with reference to the block diagram of FIG. 9.

A dummy discharge controller 701 controls the dummy discharge operation. The dummy discharge controller 701 drives the head 100 with a head drive controller 702 and causes the head 100 to discharge the liquid to the liquid receptacle 200 between the sheets P.

A drum motor drive controller 703 controls a drum motor 751 to drive the drum 51 to rotate. The drum motor drive controller 703 is implemented by a main controller of the printer 1 and drives the drum 51 while the sheet P is conveyed.

The dummy discharge controller 701 accepts a signal input from an encoder 752 that detects the rotational position of the drum 51. Based on the rotation amount of the drum 51 from a home position, the dummy discharge controller 701 causes the head 100 to discharge the liquid at the position opposite the liquid receptacle 200 (dummy discharge operation).

A discharge amount measurement unit 710 measures the amount of liquid (dummy discharge amount) discharged from the head 100 by the dummy discharge controller 701. The discharge amount measurement unit 710 measures and stores the dummy discharge amount, for example, for each liquid receptacle 200, each slit 213 of the liquid receptacle 200, or each different discharge position of the slit 213. The dummy discharge amount can be measured by, for example, multiplying the number of discharged droplets with the volume of one droplet.

Figure 10:
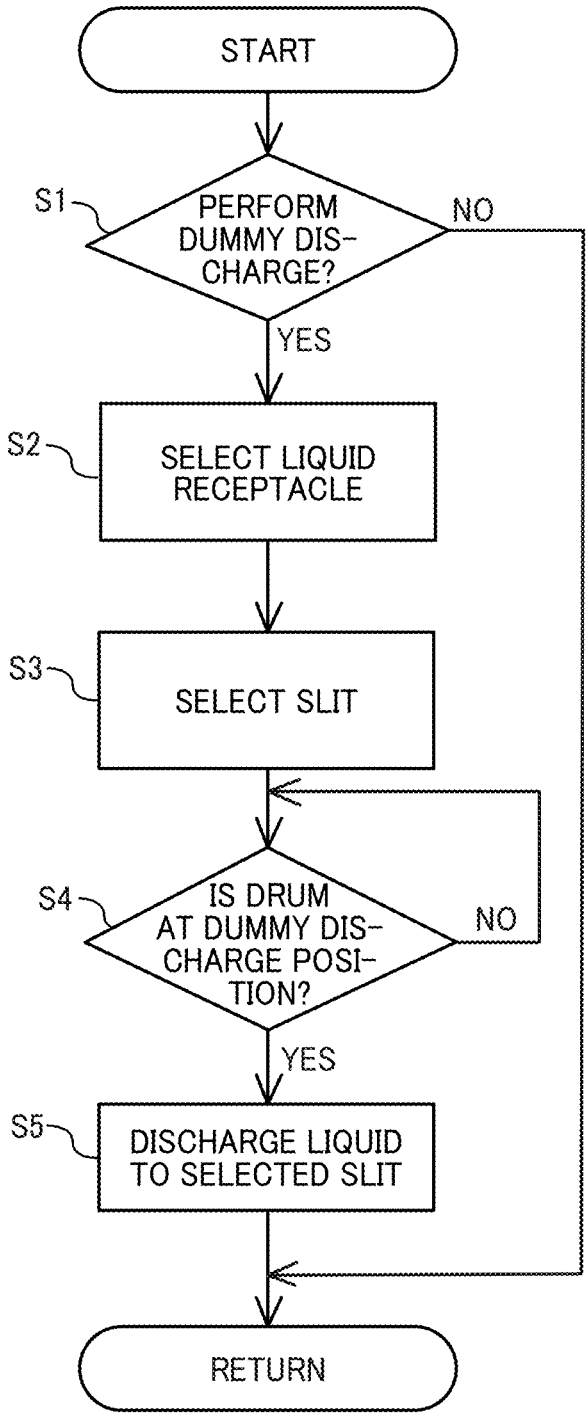
FIG. 10 is a flowchart of control of the dummy discharge operation according to the first embodiment.

Next, a description is given of control of the dummy discharge operation in the present embodiment, with reference to the flowchart of FIG. 10.

The dummy discharge controller 701 determines whether or not to perform the dummy discharge operation (Step S1, hereinafter referred to as "S1").

The dummy discharge operation is performed, for example, when printing has been performed on a predetermined number of sheets P or every time a print job on a sheet P or sheets P completes.

Further, there is a situation, such as an initial operation, where the drum 51 rotates with the head 100 decapped, although the printing is not performed on the sheet P. Therefore, the dummy discharge operation can be performed when the head 100 is in the decapped state regardless of during printing and non-printing period. In other words, although the liquid at the nozzle dries when the head 100 is decapped, the dummy discharge operation can suppress the drying of the liquid.

By contrast, the dummy discharge operation can be prohibited in a situation other than the decapped state during printing. Such control can minimize wasteful consumption of liquid due to the dummy discharge operation.

Then, when performing the dummy discharge operation, the dummy discharge controller 701 selects the liquid receptacle 200 to which the liquid is discharged (S2). In the selection of the liquid receptacle 200, the liquid receptacle 200 to which the liquid is discharged last time is regarded as an n-th liquid receptacle, and an (n+1)th liquid receptacle is selected as the target receptacle to receive the dummy discharge. For example, when the discharge has been previously performed to the liquid receptacle 200A, the liquid receptacle 200B is selected this time as the target receptacle.

That is, in a configuration in which the plurality of liquid receptacles 200 is arranged around the drum 51, the weights of the liquid receptacles 200 can be balanced by equalizing the amounts of liquid discharged to the liquid receptacles 200 to some extent. Accordingly, fluctuations in rotation due to the unbalanced weight of the drum 51 can be suppressed.

The discharge amount measurement unit 710 measures the discharge amount (amount of waste liquid) to each of the liquid receptacles 200A to 200C. When the dummy discharge controller 701 selects the liquid receptacle 200 having a small amount of waste liquid, the weights of the liquid receptacles 200 can be more precisely balanced.

Next, the slit 213 to which the liquid is to be discharged is selected from the plurality of slits 213A to 213C of the target liquid receptacle 200 (S4).

Thereafter, the dummy discharge controller 701 determines whether or not the drum 51 has reached the position (dummy discharge position) of the selected slit 213 of the liquid receptacle 200 (S4). When the head 100 reaches the dummy discharge position, the head 100 is driven to discharge the liquid toward the selected slit 213 of the discharge receptacle 200 (S5).

As described above, in the present embodiment, the rotation of the drum 51 is not stopped for the dummy discharge. The head 100 discharges the liquid to the slit 213 of the liquid receptacle 200 (dummy discharge is performed) in the state where the liquid receptacle 200 moves with the rotation of the drum 51, that is, the liquid receptacle 200 and the head 100 move relative to each other. The drum 51 serves as a moving device that relatively moves the liquid receptacles 200 and the heads 100.

The position of the slit 213 of the liquid receptacle 200 can be obtained as rotation amount (rotational position) information of the drum 51 with reference to the home position of the drum 51. Therefore, when the rotation amount of the drum 51 from the home position reaches the rotation amount representing the position of the slit 213 of the liquid receptacle 200, the liquid is discharged from the head 100. The drive timing (dummy discharge timing) of the head 100 changes depending on the rotation speed of the drum 51, the discharge speed from the head 100, the distance between the head 100 and the slit 213 of the liquid receptacle 200, and the like.

In the example described above, the target receptacle is changed among the plurality of liquid receptacles 200 for each dummy discharge operation, or based on the measurement result of the amount of liquid discharged to the liquid receptacles 200. Alternatively, for example, the liquid receptacle 200 that reaches the head 100 first can be selected as the target of dummy discharge.

Such control can reduce the time required for the selected liquid receptacle 200 to reach the dummy discharge position, and accordingly reduce the length of time of the dummy discharge operation.

Preferably, the dummy discharge is performed at a timing between sheets (sheet interval) during consecutive printing in which printing is consecutively performed on a plurality of sheets. Alternatively, when performing a plurality of print jobs for printing on a plurality of sheets, the dummy discharge can be performed at timing between print jobs.

Further, the measurement of the amount of liquid discharged for each liquid receptacle 200 can be obviated in the following handling. For example, when one of the liquid receptacles 200 becomes full, the apparatus can prompt the user to replace all the liquid receptacles 200. Such handling can reduce the number of times of replacement work of the liquid receptacles 200.

Figure 11:
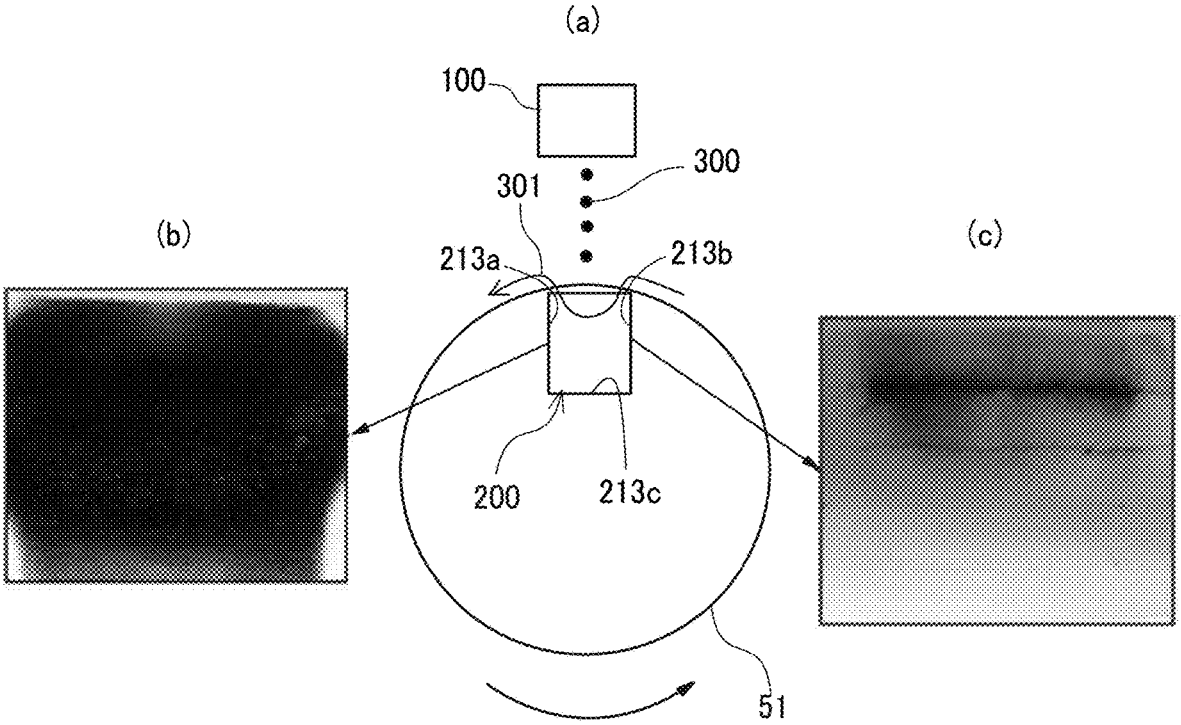
FIG. 11 is a diagram illustrating an effect of performing dummy discharge by relatively moving the liquid receptacle and a head according to the first embodiment.

Next, a description is given of effects of performing dummy discharge while relatively moving the liquid receptacles and the heads, with reference also to FIG. 11.

As illustrated in a diagram (a) in FIG. 11, when liquid 300 is discharged toward the slit 213 while the liquid receptacle 200 and the head 100 move relative to each other, an airflow 301 occurs inside the slit 213 of the liquid receptacle 200 with the rotation of the drum 51.

The liquid 300 discharged into the slit 213 by the airflow 301 adheres more to side wall surfaces 213*a* and 213*b* of the slit 213 than to a bottom surface 213*c* (see also FIG. 7) of the slit 213. Further, regarding the side wall surfaces 213*a* and 213*b* of the slit 213, the liquid 300 adheres more to the side wall on the downstream side of the airflow 301, for example, the side wall surface 213*a*. Diagrams (b) and (c) in FIG. 11 illustrate the results of observation of the liquid adhering state in the slit 213.

As described above, the liquid 300 is caused to adhere to the side wall surfaces 213*a* and 213*b* of the slit 213. This configuration is advantageous in retarding the growth of deposit, compared with a case where a deposit formed by drying of the liquid 300 grows from the bottom surface 213*c* of the slit 213.

Thus, according to the liquid receptacle 200 of the present embodiment, the useful life of the liquid receiver 201 can be extended, and the frequency of replacement of the liquid receptacle 200 can be reduced.

Next, a liquid receiver according to a second embodiment of the present disclosure is described with reference to FIG.

Figure 12:
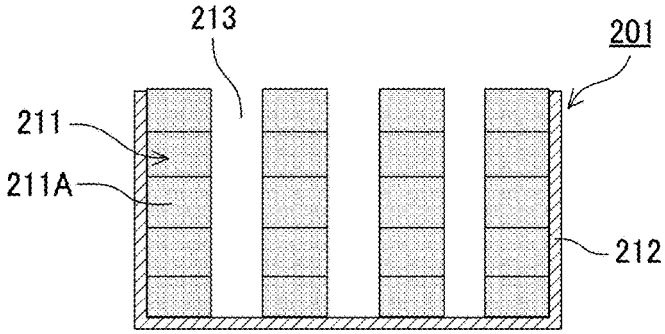
FIG. 12 is a cross-sectional view of a liquid receiver according to a second embodiment, along the short-side direction thereof.

12. FIG. 12 is a cross-sectional view of the liquid receiver along the short-side direction thereof.

In the present embodiment, the absorber 211 is formed by sequentially laminating the plurality of absorbing members 211A on the bottom face of the absorber case 212. Each absorbing member 211A includes the through grooves 211*a* (see FIG. 8) that form the slits 213, similar to the first embodiment.

As a result, the cost can be reduced because the absorber 211 is constructed of the absorbing members 211A having the same shape.

Figure 13:
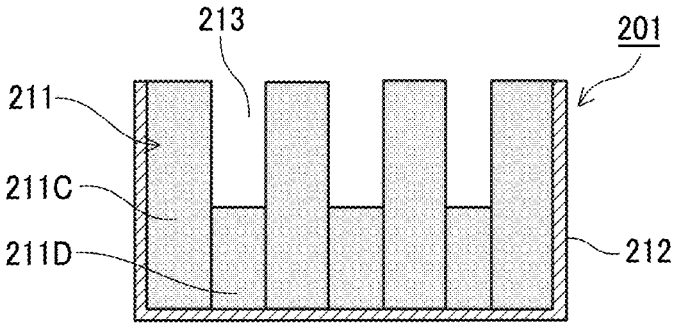
FIG. 13 is a cross-sectional view of a liquid receiver according to a third embodiment, along the short-side direction thereof.

Next, a liquid receiver according to a third embodiment of the present disclosure is described with reference to FIG. 13. FIG. 13 is a cross-sectional view of the liquid receiver along the short-side direction thereof.

In the present embodiment, the absorber 211 uses two types of absorbing members 211C and 211D having different lengths. The absorbing members 211C and 211D are alternately arranged so that the short absorbing member 211D (second absorbing members) is sandwiched between the long absorbing members 211C (first absorbing members). The spaces above the absorbing members 211D serve as the slits 213.

This structure requires only making the length of the absorbing members 211C and 211D different, and the processing of the absorbing members becomes easy.

Figure 14:
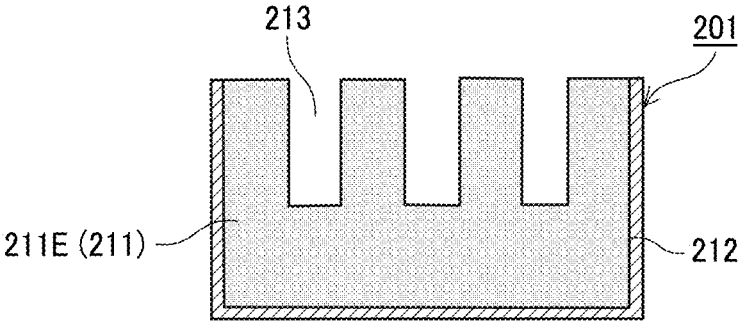
FIG. 14 is a cross-sectional view of a liquid receiver according to a fourth embodiment, along the short-side direction thereof.

Next, a liquid receiver according to a fourth embodiment of the present disclosure is described with reference to FIG. 14. FIG. 14 is a cross-sectional view of the liquid receiver along the short-side direction thereof.

In the present embodiment, the absorber 211 is formed by engraving the slits 213 in one absorbing member 211E.

Such a method can reduce the number of components and improve the workability in mounting the absorber 211 in the absorber case 212.

In each of the above-described embodiments, the relationship between the slit 213 and the color of the liquid to be discharged in dummy discharge can be fixed, and the width of the slit 213 in the short-side direction can be changed according to the color of the liquid.

Such setting can equalize the deposition height in each slit 213 when liquids having different deposition rates are used.

Figure 15:
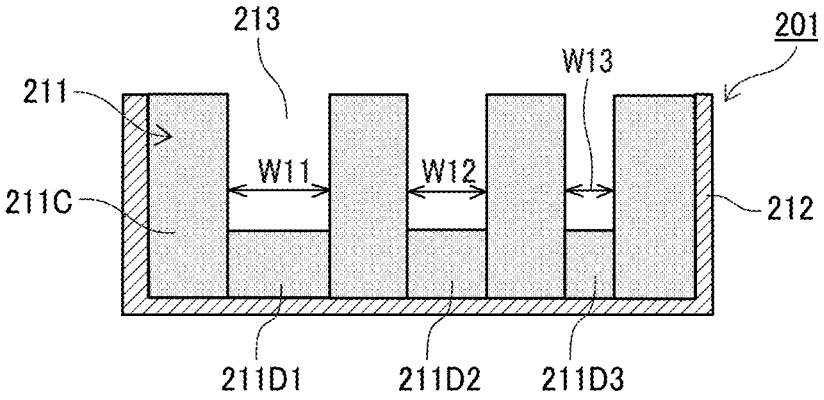
FIG. 15 is a cross-sectional view of a liquid receiver according to a fifth embodiment, along the short-side direction thereof.

Next, a liquid receiver according to a fifth embodiment of the present disclosure is described with reference to FIG. 15. FIG. 15 is a cross-sectional view of the liquid receiver along the short-side direction thereof.

In the present embodiment, the absorber 211 includes absorbing members 211D1 to 211D3 having widths W different in the short-side direction of the slit 213, corresponding to the colors of the liquids. Here, a width W11 of the absorbing member 211D1, a width W12 of the absorbing member 211D2, and a width W13 of the absorbing member 211D3 satisfy the relationship expressed as W11>W12>W13. However, the relationship is not limited thereto.

In this configuration, the liquid of frequently discharged color is discharged to the wide slit 213, and the liquid of less frequently discharged color is discharged to the narrow slit 213, thereby leveling the deposition height in each slit 213.

Figure 16:
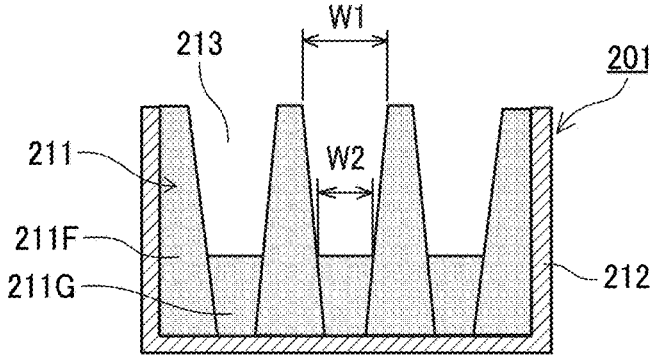
FIG. 16 is a cross-sectional view of a liquid receiver according to a sixth embodiment, along the short-side direction thereof.

Next, a liquid receiver according to a sixth embodiment is described with reference to FIG. 16. FIG. 16 is a cross-sectional view of the liquid receiver along the short-side direction thereof.

In the present embodiment, the absorber 211 is constructed combining absorbing members 211F and 211G. With this structure, the widths W (W1 and W2) of the slits 213 in the relative movement direction differ in the height direction. The slit 213 of the absorber 211 is shaped so that a width W1 on the entrance side is wider than a width W2 on the bottom side. That is, the width of the slit 213 increases as the position in the height direction becomes closer to the nozzle of the head 100.

This structure is advantageous in a case where the liquid easily adheres to upper portions of the side wall surfaces 213*a* and 213*b* of the slit 213 due to the type of liquid and the discharge conditions. This structure can increase the area where the liquid can be deposited, thereby extending the useful life.

Figure 17:
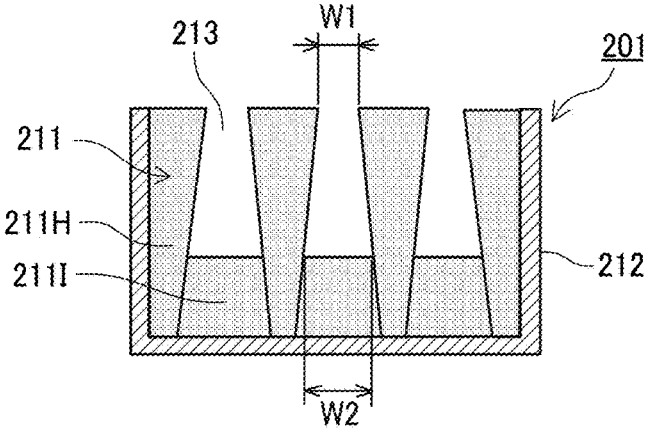
FIG. 17 is a cross-sectional view of a liquid receiver according to a seventh embodiment, along the short-side direction thereof.

Next, a liquid receiver according to a seventh embodiment is described with reference to FIG. 17. FIG. 17 is a cross-sectional view of the liquid receiver along the short-side direction thereof.

In the present embodiment, the absorber 211 is constructed combining absorbing members 211H and 211I. This structure forms the slits 213 whose widths W (W1 and W2) in the relative movement direction differ in the height direction. The slit 213 of the absorber 211 is shaped so that the width W2 on the bottom side is wider than the width W1 on the entrance side. That is, the width of the slit 213 increases as the position in the height direction draws away from the nozzle of the head 100.

This structure is advantageous when the liquid easily adheres to lower portions of the side wall surfaces 213*a* and 213*b* of the slit 213 due to the type of liquid and the discharge conditions. This structure can increase the area where the liquid can be deposited, thereby extending the useful life.

Figure 18:
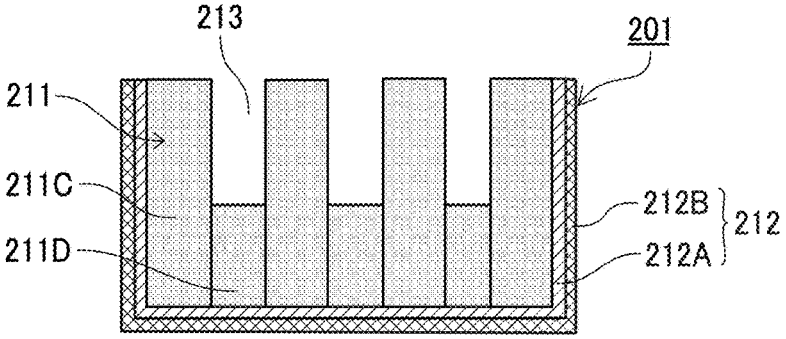
FIG. 18 is a cross-sectional view of a liquid receiver according to an eighth embodiment, along the short-side direction thereof.

Next, a liquid receiver according to an eighth embodiment is described with reference to FIG. 18. FIG. 18 is a cross-sectional view of the liquid receiver along the short-side direction thereof.

In the present embodiment, the absorber case 212 includes a film case 212A and a holding case 212B. The absorber 211 is the same as that of the third embodiment, but can be the same as that of another embodiment. This applies to the following embodiments similarly.

The film case 212A is made of a material having no liquid permeability (for example, a plastic film) to store the discharged liquid. By contrast, the holding case 212B is made of a material (paper, plastic, etc.) capable of keeping the shape of the film case 212A and has such a shape to keep the shape of the film case 212A. When the holding case 212B is made of paper, the cost can be reduced, recyclability can be improved, and weight can be reduced.

Figure 19:
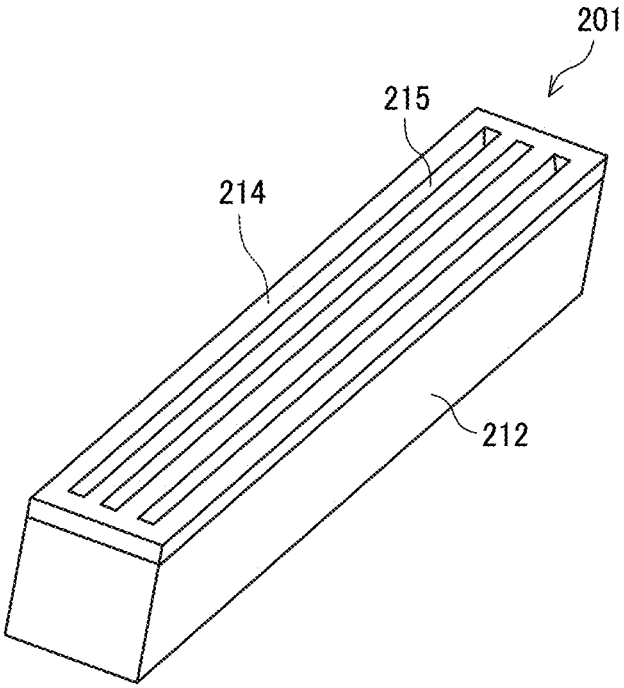
FIG. 19 is a perspective view of a liquid receiver according to a ninth embodiment.
Figure 20:
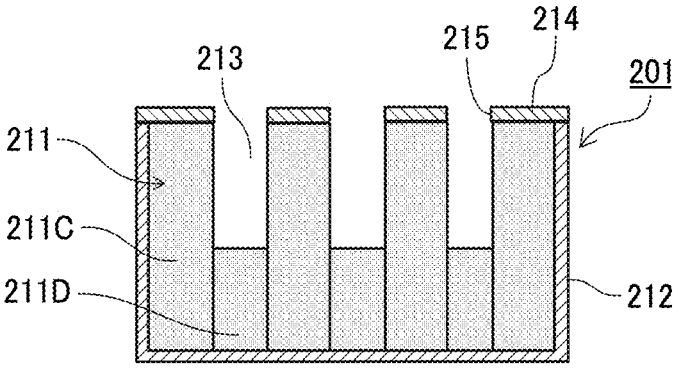
FIG. 20 is a cross-sectional view of the liquid receiver according to the ninth embodiment; along the short-side direction thereof.

Next, a liquid receiver according to a ninth embodiment is described with reference to FIGS. 19 and 20. FIG. 19 is a perspective view of the liquid receiver. FIG. 20 is a cross-sectional view of the liquid receiver along the short-side direction thereof.

In the present embodiment, the liquid receiver 201 includes a lid 214 that covers the opening side of the absorber case 212. The lid 214 includes openings 215 corresponding to the slits 213.

This structure can prevent the absorber 211 from popping out from the absorber case 212 outward in the radial direction of the drum 51 when the liquid receptacle 200 is rotated by the rotation of the drum 51.

Figure 21:
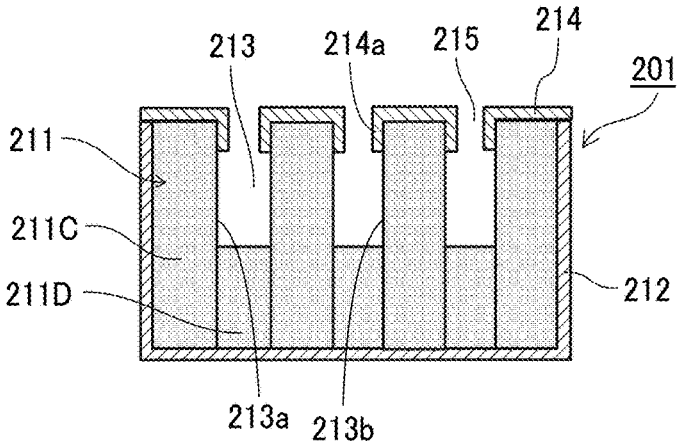
FIG. 21 is a cross-sectional view of a liquid receiver according to a tenth embodiment, along the short-side direction thereof.

A description is given below of a liquid receiver according to tenth embodiment with reference to FIG. 21. FIG. 21 is a cross-sectional view of the liquid receiver along the short-side direction thereof.

In the present embodiment, the liquid receiver 201 includes the lid 214 that covers the opening side of the absorber case 212. The lid 214 includes the openings 215 corresponding to the slits 213 and further includes bent portions 214*a*. The bent portions 214*a* are folded to the side wall surfaces 213*a* and 213*b*.

This structure can prevent the absorber 211 from popping out from the absorber case 212 outward in the drum radial direction, and regulate the position of the absorber 211 in the width direction. In particular, this configuration is advantageous for a configuration in which long and short absorbing members 211C and 211D are alternately arranged like the absorber 211 of the third embodiment. That is, although the long absorbing member 211C may fall down absorbing the waste liquid over time, this structure can prevent such falling down.

Figure 22:
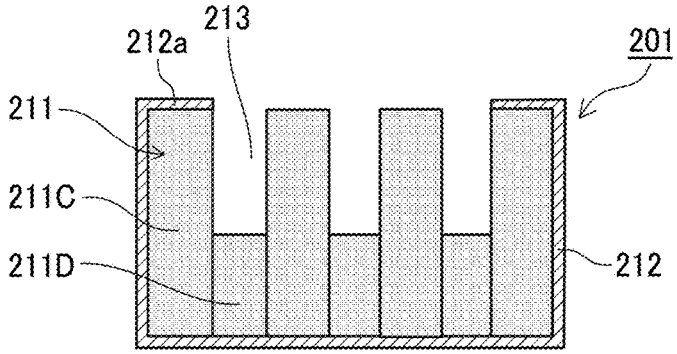
FIG. 22 is a cross-sectional view of a liquid receiver according to an eleventh embodiment, along the short-side direction thereof.

A description is given below of a liquid receiver according to an eleventh embodiment with reference to FIG. 22. FIG. 22 is a cross-sectional view of the liquid receiver along the short-side direction thereof.

In the present embodiment, the absorber case 212 of the liquid receiver 201 includes a bent portion 212*a* at the opening thereof.

Accordingly, the position in the height direction of the absorber 211 can be regulated.

Note that, in the configuration using the absorber 211 of the third embodiment as in the present embodiment, the absorbing members 211C and 211D are contactless with the bent portion 212*a*. However, the absorbing members 211C and 211D contactless with the bent portion 212*a* are held by the frictional force between the absorbing members 211C and 211D.

Figure 23:
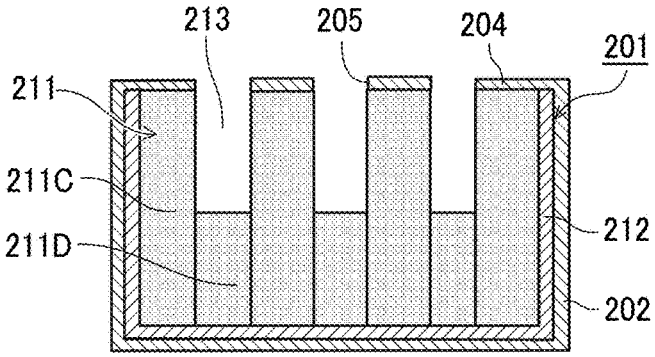
FIG. 23 is a cross-sectional view of a liquid receiver according to a twelfth embodiment, along the short-side direction thereof.

A description is given below of a liquid receiver according to a twelfth embodiment with reference to FIG. 23. FIG. 23 is a cross-sectional view of the liquid receiver along the short-side direction thereof.

In the present embodiment, the support case 202 of the liquid receptacle 200 includes a lid 204 as an integral part thereof. The lid 204 covers the opening side of the absorber case 212 and includes openings 205 facing the slits 213.

This structure can prevent the absorber 211 from popping out from the absorber case 212 outward in the drum radial direction due to the rotation of the liquid receptacle 200.

Figure 24:
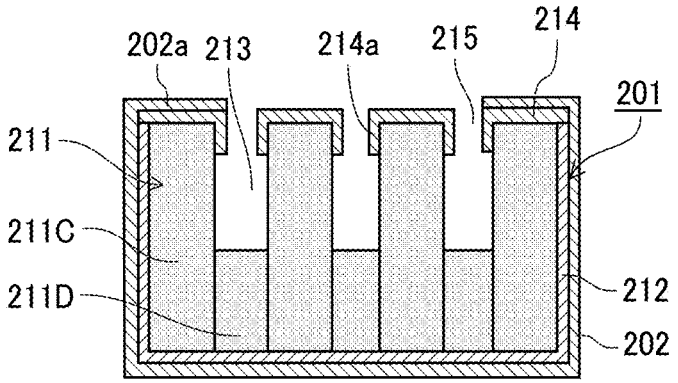
FIG. 24 is a cross-sectional view of a liquid receiver according to a thirteenth embodiment, along the short-side direction thereof.

A description is given below of a liquid receiver according to a thirteenth embodiment with reference to FIG. 24. FIG. 24 is a cross-sectional view of the liquid receiver along the short-side direction thereof.

In the present embodiment, the support case 202 of the liquid receptacle 200 includes a bent portion 202*a* at the opening thereof.

This structure can prevent the liquid receiver 201 from popping out from the support case 202 outward in the drum radial direction due to the rotation of the liquid receptacle 200.

Figure 25:
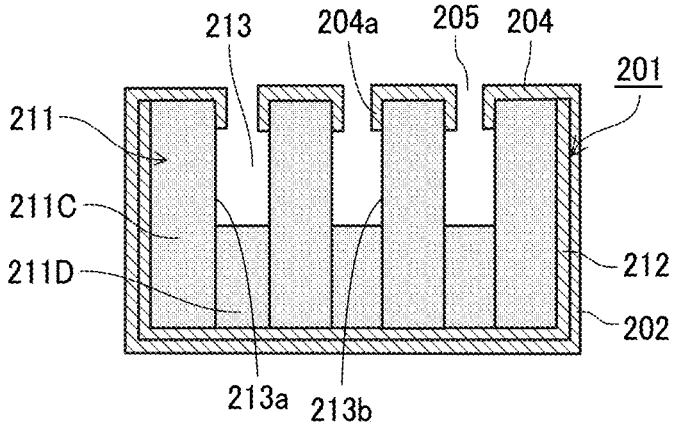
FIG. 25 is a cross-sectional view of a liquid receiver according to a fourteenth embodiment, along the short-side direction thereof.

A description is given below of a liquid receiver according to a fourteenth embodiment with reference to FIG. 25. FIG. 25 is a cross-sectional view of the liquid receiver along the short-side direction thereof.

In the present embodiment, the support case 202 of the liquid receptacle 200 includes the lid 204, as an integral part thereof, that covers the opening side of the absorber case 212. The lid 204 includes the openings 205 facing the slits 213. The lid 204 further includes bent portions 204*a* bent onto the side wall surfaces 213*a* and 213*b* enclosing the slits 213.

This structure can prevent the absorber 211 from popping out from the absorber case 212 outward in the drum radial direction, and regulate the position of the absorber 211 in the width direction.

Accordingly, the absorber 211 can be prevented from popping out from the absorber case 212 outward in the drum radial direction due to the rotation of the liquid receptacle 200.

Figure 26:
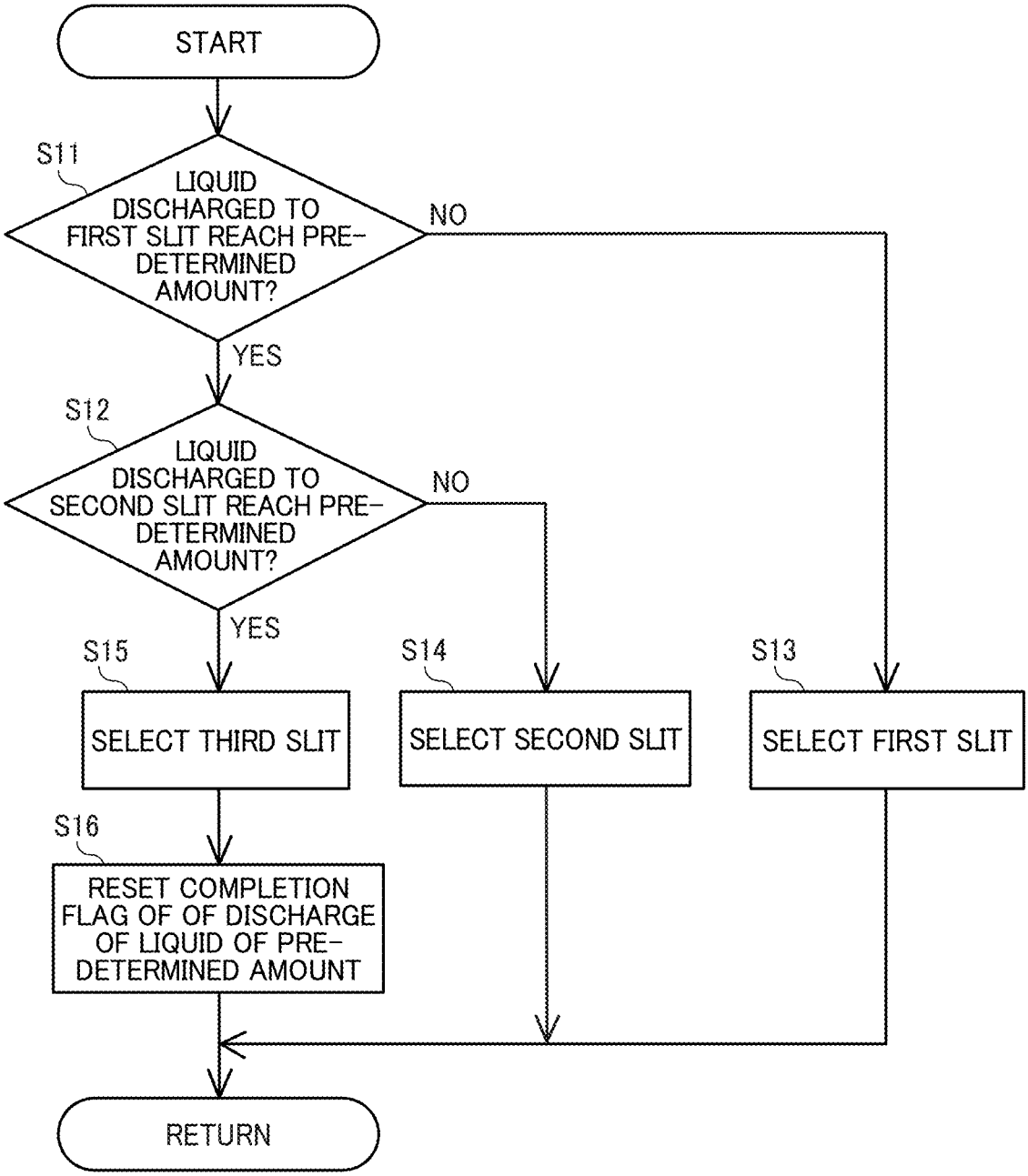
FIG. 26 is a flowchart of selection of discharge target slit in control of dummy discharge operation, according to a fifteenth embodiment.
Figure 27A:
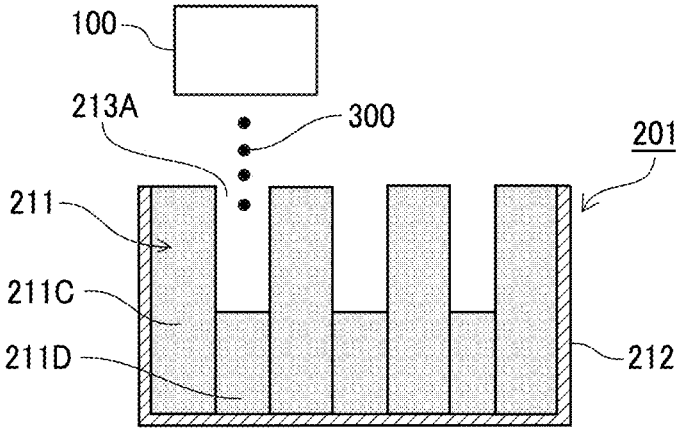
FIGS. 27A to 27C are cross-sectional views of the liquid receiver along the short-side direction thereof, in states corresponding to the flowchart in FIG. 26.
Figure 27B:
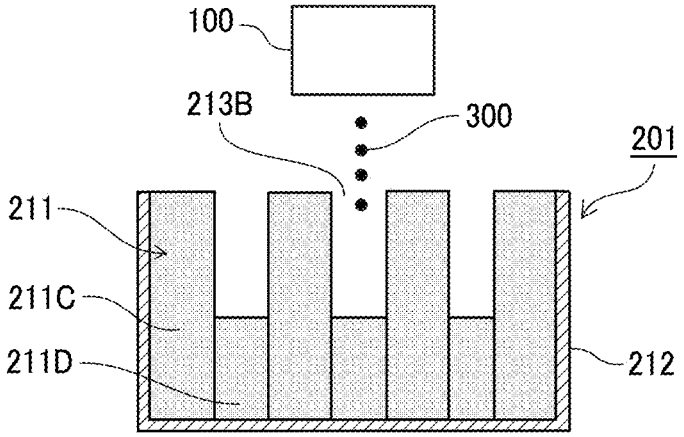
Figure 27C:
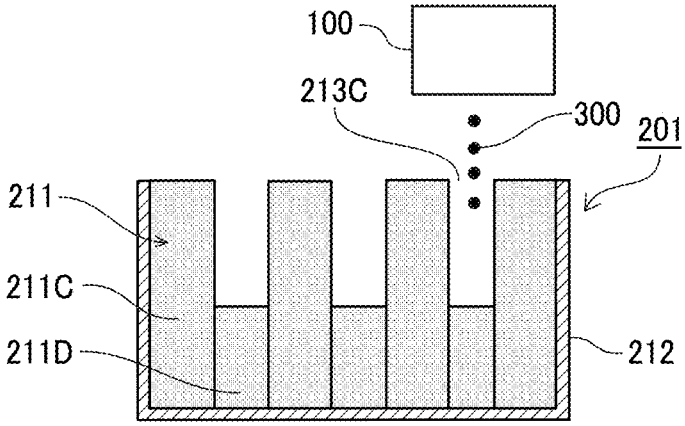

Next, control of the dummy discharge operation according to a fifteenth embodiment of the present disclosure is described with reference to FIGS. 26 to 27C. FIG. 26 is a flowchart of selection of discharge target slit in control of the dummy discharge operation. FIGS. 27A to 27C are cross-sectional views of the liquid receiver along the short-side direction thereof.

In the process of selecting the slit to which the liquid is discharged, the dummy discharge controller 701 determines whether or not the amount of liquid discharged to the first slit has reached a predetermined amount (S11). When the predetermined amount of liquid has not yet been discharged to the first slit, the first slit is selected as the discharge target slit (S13). The predetermined amount is, for example, stored in a memory by a manufacturer based on empirical data. Then, for example, the slit 213A is selected, and the liquid 300 is discharged from the head 100 to the slid 213A as illustrated in FIG. 27A.

When the predetermined amount of liquid has been discharged to the first slit, the dummy discharge controller 701 determines whether or not the amount of liquid discharged to the second slit has reached a predetermined amount (S12). When the predetermined amount of liquid has not yet been discharged to the second slit, the second slit is selected as the discharge target slit (S14). Then, for example, the slit 213B is selected, and the liquid 300 is discharged from the head 100 to the slid 213A as illustrated in FIG. 27B.

When the predetermined amount of liquid has been discharged to the second slit, the third slit is selected as the discharge target slit (S15). Then, for example, the slit 213C is selected, and the liquid 300 is discharged from the head 100 to the slid 213A as illustrated in FIG. 27C.

Then, when the third slit is selected as the discharge target slit, a flag of each slit 213 representing completion of discharge of the predetermined amount of liquid is reset (S16). Thus, next time, the discharge is started again from the first slit.

As described above, in the structure including the plurality of slits 213, the discharge target slit is changed every time the predetermined amount of liquid has been discharged (every time the discharge amount exceeds a threshold). Accordingly, the deposition of the waste liquid can be dispersed per slit, thereby increasing the area where the waste liquid can be deposited. Further, the liquid is discharged to the same slit 213 until the discharge amount reaches a certain amount, which is advantageous when a liquid that dries easily is used. The surface of the waste liquid that has landed on the liquid receptacle 200 is less likely to dry, and the deposition rate of the waste liquid can be reduced.

In the present embodiment, the liquid is discharged while changing the slits in the order from the extreme downstream slit 213A to the extreme upstream slit 213C in the moving direction of the absorber 211. In other words, the liquid can be discharged while changing the slits in the order of the slit that opposes the head 100 as the absorber 211 enters under the head 100 by rotation of the drum 51.

By discharging the liquid while changing the slits in this order, the liquid can be discharged to a plurality of locations in the liquid receptacle 200 in accordance with the direction of rotation of the drum 51, and the control can be simplified.

Alternatively, the liquid can be discharged while changing the slits in the order from the extreme upstream stream slit 213C to the extreme downstream slit 213A in the moving direction of the absorber 211.

Figure 28:
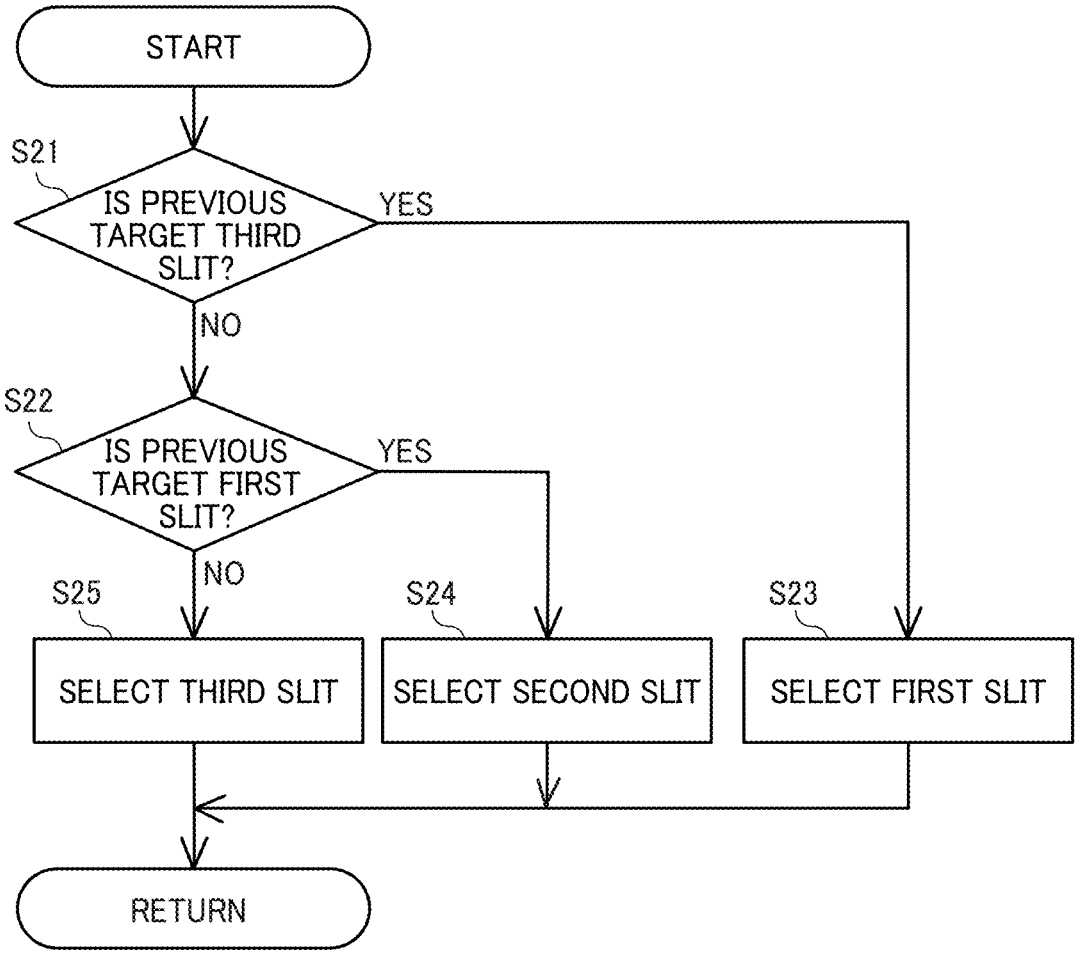
FIG. 28 is a flowchart of selection of discharge target slit in the control of dummy discharge operation according to a sixteenth embodiment of the present disclosure.

Next, a description is given of control of the dummy discharge operation according to a sixteenth embodiment of the present disclosure, with reference also to FIG. 28. FIG. 28 is a flowchart of selection of discharge target slit in control of the dummy discharge operation.

In the present embodiment, the dummy discharge controller 701 determines whether or not the discharge target slit in the previous dummy discharge operation is the third slit (S21). When the discharge target slit in the previous dummy discharge operation is the third slit, the first slit is selected as the discharge target slit (S23).

When the discharge target slit in the previous dummy discharge operation is not the third slit, the dummy discharge controller 701 determines whether or not the previous discharge target slit is the first slit (S22). When the discharge target slit in the previous dummy discharge operation is the first slit, the second slit is selected as the discharge target slit (S24).

When the target slit in the previous dummy discharge operation is not the first slit, the third slit is selected as the target slit (S25).

In this manner, every time the dummy discharge operation is performed, the discharge target slit is changed, that is, the liquid is not continuously discharged to the same slit. Such control can extend the permeation time of a hard-to-dry liquid into the absorber 211, thereby inhibiting deposition on the surface of the absorber 211.

Figure 29:
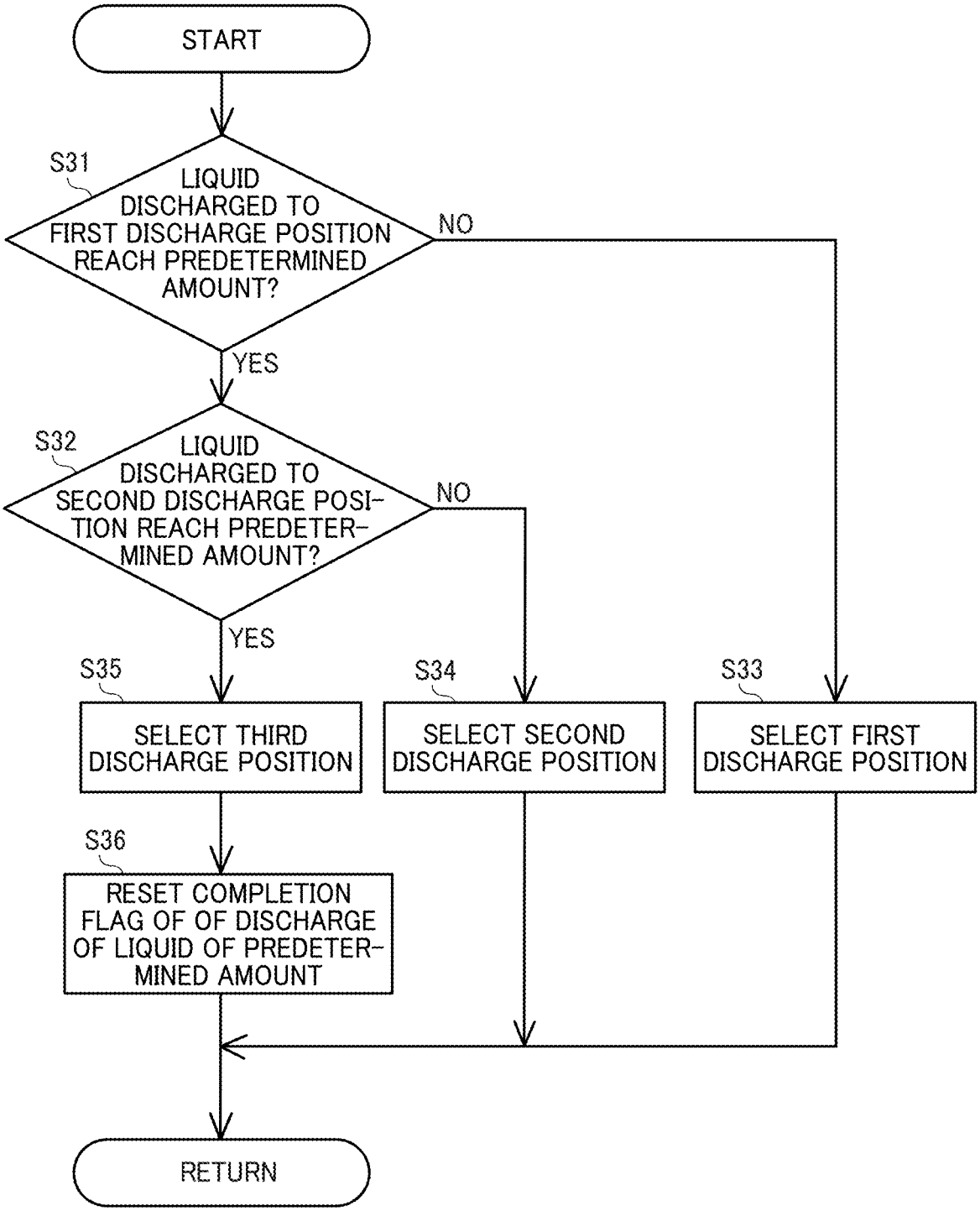
FIG. 29 is a flowchart of selection of discharge position in the control of dummy discharge operation according to a seventeenth embodiment of the present disclosure.

Next, control of the dummy discharge operation according to a seventeenth embodiment of the present disclosure is described with reference to FIGS. 29 to 30C. FIG. 29 is a flowchart of selection of discharge position in control of the dummy discharge operation. FIGS. 30A to 30C are cross-sectional views of the liquid receiver along the short-side direction thereof.

In the discharge position selection processing, a plurality of discharge positions to which the liquid is discharged is set in the same slit 213, and the discharge position in the dummy discharge operation, that is, the relative position between the head 100 and one slit 213 is changed.

Figure 30A:
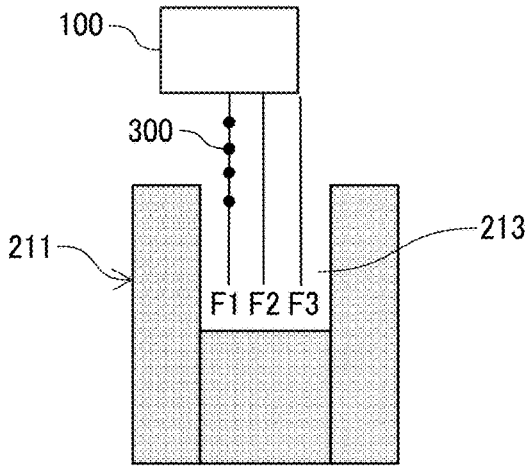
FIGS. 30A to 30C are cross-sectional views of the liquid receiver along the short-side direction thereof.
Figure 30B:
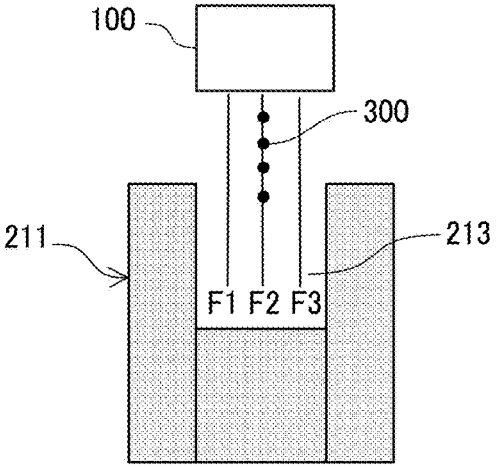
Figure 30C:
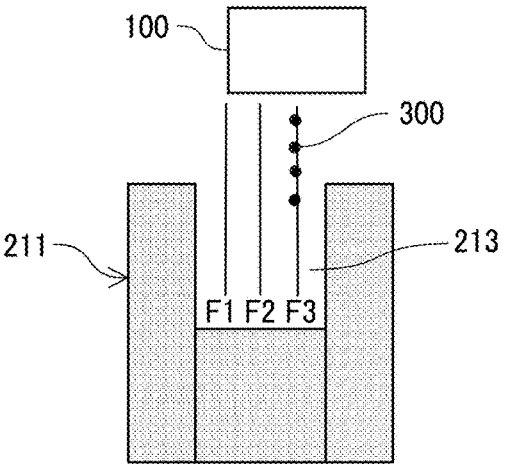

For example, when first to third discharge positions F1 to F3 are set as illustrated in FIGS. 30A to 30C, the dummy discharge controller 701 determines whether a predetermined amount of liquid has been discharged to the first discharge position F1 (S31). When the predetermined amount of liquid has not yet been discharged to the first discharge position F1, the first discharge position F1 is selected as a target discharge position (S33). Accordingly, for example, the liquid 300 is discharged from the head 100 to the first discharge position F1 as illustrated in FIG. 30A.

When the predetermined amount of liquid has been discharged to the first discharge position F1, the dummy discharge controller 701 determines whether a predetermined amount of liquid has been discharged to the second discharge position F2 (S32). When the predetermined amount has not yet been discharged to the second discharge position F2, the second discharge position is selected as the target discharge position (S34). Accordingly, for example, as illustrated in FIG. 30B, the liquid 300 is discharged from the head 100 to the second discharge position F2.

When the predetermined amount of liquid has been discharged to the second discharge position F2, the third discharge position F3 is selected as the target discharge position (S35). As a result, for example, as illustrated in FIG. 30C, the liquid 300 is discharged from the head 100 to the third discharge position F3.

When the third discharge position F3 is selected as the target discharge position, the flag of each discharge position representing completion of discharge of the predetermined amount of liquid is reset (S36). Thus, next time, the discharge is started again from the first discharge position.

As described above, in the structure including a plurality of discharge positions, the target discharge position is changed every time a predetermined amount of liquid is discharged. Accordingly, the deposition of the waste liquid can be dispersed, thereby increasing the area where the waste liquid can be deposited and extending the useful life. Thus, the frequency of replacement can be reduced.

Figure 31:
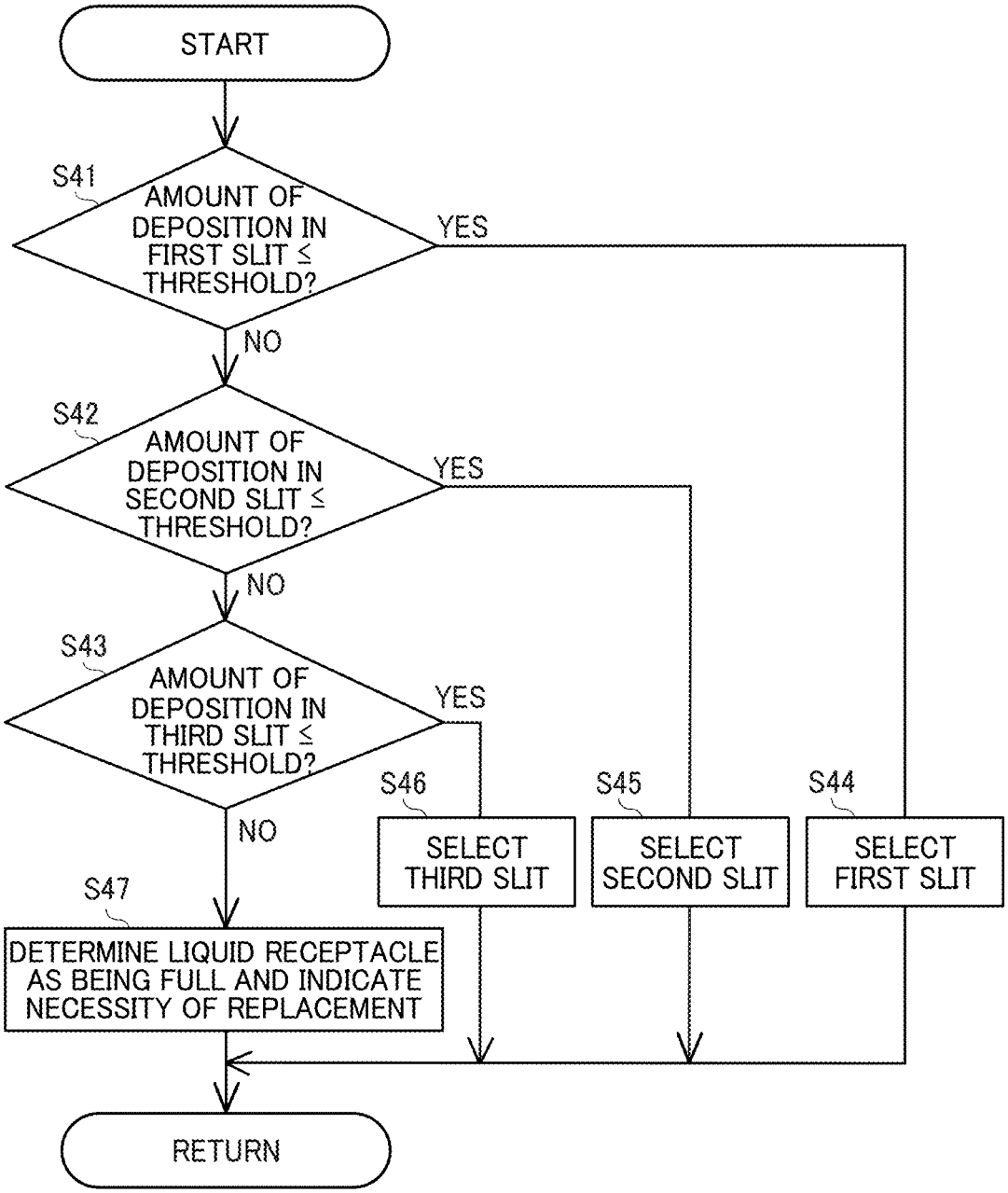
FIG. 31 is a flowchart of selection of discharge target slit in the control of dummy discharge operation according to an eighteenth embodiment of the present disclosure.
Figure 32:
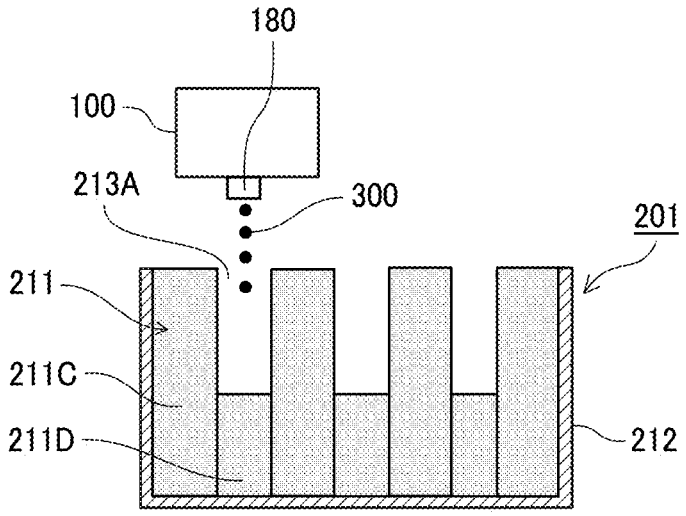
FIG. 32 is a cross-sectional view of the liquid receiver along the short-side direction.

Next, the control of the dummy discharge operation in an eighteenth embodiment of the present disclosure is described with reference to FIGS. 31 and 32. FIG. 31 is a flowchart of selection of discharge target slit in control of the dummy discharge operation. FIG. 32 is a cross-sectional view of the liquid receiver along the short-side direction thereof.

In the present embodiment, as illustrated in FIG. 32, the head 100 includes a contactless detector 180 to detect the amount (deposition height) of the waste liquid in the slit 213.

Referring to FIG. 31, the dummy discharge controller 701 determines whether or not the deposition amount in the first slit is equal to or smaller than a threshold (S41). At this time, when the deposition amount in the first slit is equal to or smaller than the threshold, the first slit is selected as a discharge target slit (S44).

When the deposition amount in the first slit is not equal to or smaller than the threshold, the dummy discharge controller 701 determines whether the deposition amount in the second slit is equal to or smaller than the threshold (S42). At this time, when the deposition amount in the second slit is equal to or smaller than the threshold, the second slit is selected as the discharge target slit (S45).

When the deposition amount in the second slit is not equal to or smaller than the threshold, the dummy discharge controller 701 determines whether the deposition amount in the third slit is equal to or smaller than the threshold (S43). At this time, when the deposition amount in the third slit is equal to or smaller than the threshold, the third slit is selected as the discharge target slit (S46).

When the deposition amount in the third slit is not equal to or smaller than the threshold, the liquid receptacle 200 is regarded as being full-filled, and replacement is prompted (S47).

As described above, in the structure including a plurality of slits, the target discharge position is changed every time the deposition amount reaches the threshold. Accordingly, the deposition of the waste liquid can be dispersed, thereby extending the useful life, and reducing the frequency of replacement.

Note that, although the present embodiment is described using an example in which the discharge slit is selected, alternatively a plurality of discharge positions can be set as in the above-described seventeenth embodiment. In such a case, the deposition amount at each discharge position is detected, and the discharge position can be changed each time the deposition amount reaches the threshold.

Yet alternatively, the first slit to the third slit can be set in the order from the extreme downstream slit 213A to the extreme upstream slit 213C in the moving direction of the absorber 211. The order can be expressed as the order of the slit that opposes the head 100 as the absorber 211 enters under the head 100 by rotation of the drum 51.

Alternatively, the first slit to the third slit can be set in the order from the extreme upstream slit 213C to the extreme downstream slit 213A in the moving direction of the absorber 211.

Further, the discharge position can be changed based on the discharge amount, instead of the deposition amount (deposition height) of waste liquid, detected by the contactless detector 180.

Figure 33:
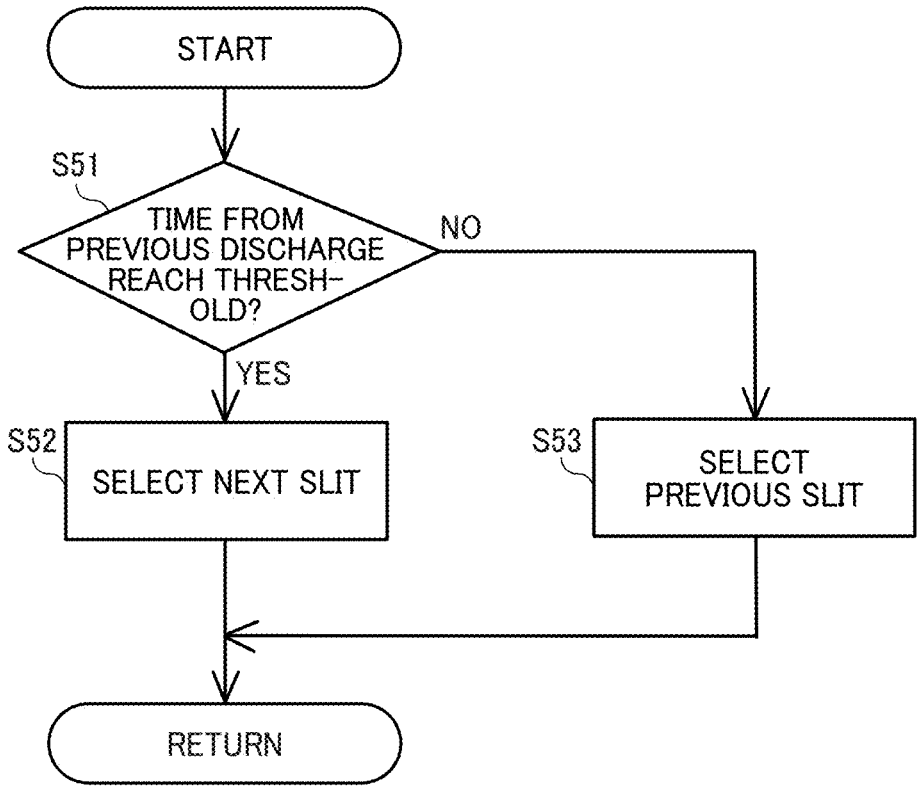
FIG. 33 is a flowchart of selection of discharge target slit in the control of dummy discharge operation according to a nineteenth embodiment of the present disclosure.

Next, a description is given of control of the dummy discharge operation according to a nineteenth embodiment of the present disclosure, with reference also to FIG. 33. FIG. 33 is a flowchart of selection of discharge target slit in control of the dummy discharge operation.

In the present embodiment, the dummy discharge controller 701 determines whether or not a predetermined time has elapsed from the previous discharge of liquid (S51). For example, the predetermined time is stored in a memory by the manufacturer based on empirical data. When the predetermined time has not yet elapsed, the slit 213 to which the liquid is discharged in the previous discharge is selected (S53). When the predetermined time has elapsed, the next slit 213 is selected (S52).

In this manner, every time the predetermined time elapses from the previous dummy discharge operation, the discharge target slit is changed. Such control can secure the permeation time of the waste liquid into the absorber 211, thereby inhibiting deposition of the liquid on the surface of the absorber 211.

Figure 34:
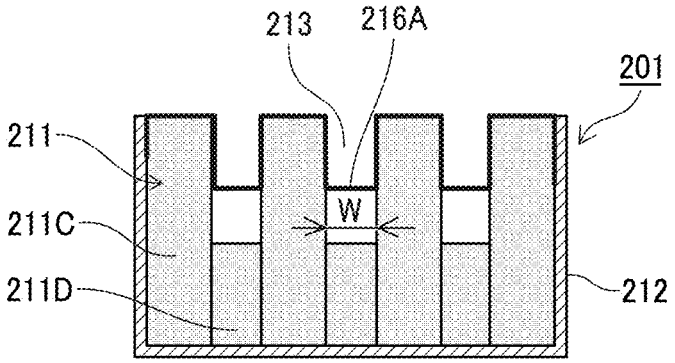
FIG. 34 is a cross-sectional view of a liquid receiver according to a twentieth embodiment of the present disclosure, taken along the short-side direction.
Figure 35:
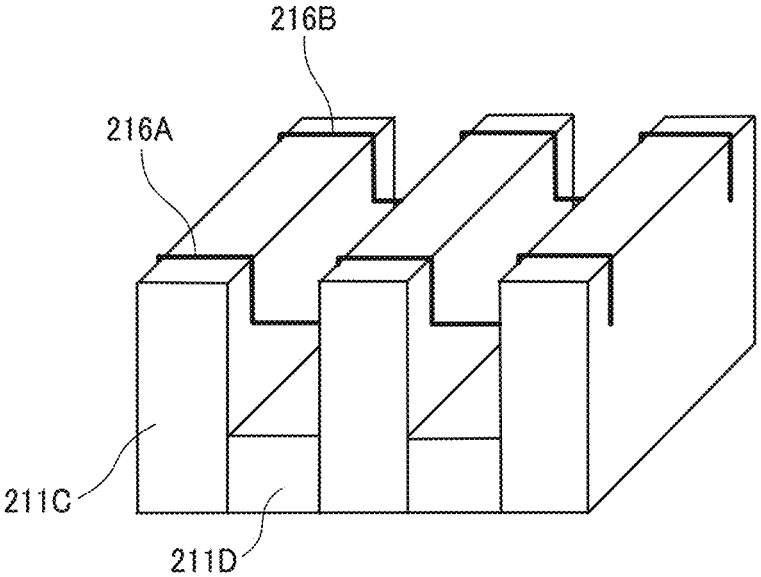
FIG. 35 is a perspective view of an absorber and a slit width retainer of the liquid receptacle according to the twentieth embodiment.

Next, a liquid receiver according to a twentieth embodiment is described with reference to FIGS. 34 and 35. FIG. 34 is a cross-sectional view of the liquid receiver along the short-side direction thereof. FIG. 35 is a perspective view of an absorber and a slit width retainer of the liquid receiver.

In the present embodiment, the liquid receiver 201 includes slit width retainers 216 (216A and 216B) on the opening side of the absorber case 212. The slit width retainers 216 secure the slit widths W of the slits 213.

The slit width retainer 216 is formed as follows. Bend a linear member made of, e.g., stainless steel to form projecting portions and recessed portions, and fit the projecting portions and recessed portions on tops of the absorbing members 211C and between the absorbing members 211C and 211C.

In the longitudinal direction of the liquid receiver 201, a plurality of slit width retainers 216A and 216B is arranged. The number of the slit width retainers 216 can be three or more.

This structure can reduce variations of the slit width W of the slits 213 due to the swing of the absorbing member 211C by the rotation of the liquid receptacle 200 and the manner of fitting of the absorbing members 211C and 211D.

Figure 36:
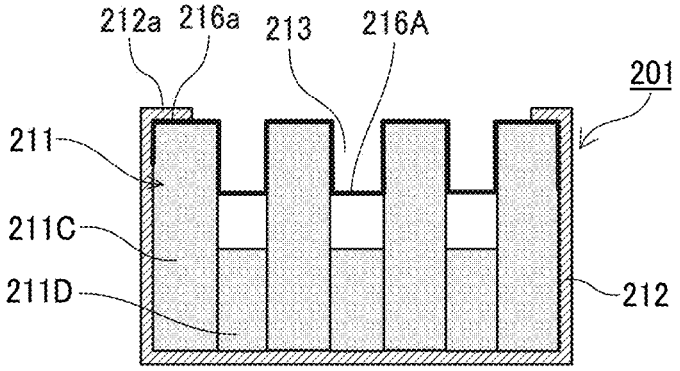
FIG. 36 is a cross-sectional view of a liquid receiver according to a twenty-first embodiment of the present disclosure, taken along the short-side direction.

A description is given below of a liquid receiver according to a twenty-first embodiment with reference to FIG. 36. FIG. 36 is a cross-sectional view of the liquid receiver along the short-side direction thereof.

In the present embodiment, in addition to the structure according to the twentieth embodiment, the absorber case 212 includes the bent portion 212*a* that covers a portion of the top of the absorbing members 211C and 211C on both sides.

Then, a portion 216*a* of the slit width retainer 216 is sandwiched between the bent portion 212*a* of the absorber case 212 and the top of the absorbing member 211C.

This structure can prevent the absorbing members 211C and the slit width retainer 216 from popping out from the absorber case 212 outward in the drum radial direction due to the rotation of the liquid receptacle 200.

In the present embodiment, the slit width retainer 216 is also sandwiched between the absorber case 212 and the outer wall surface of the absorbing member 211C. Thus, the absorbing members 211C and the slit width retainer 216 can be more reliably prevented from popping out.

Figure 37:
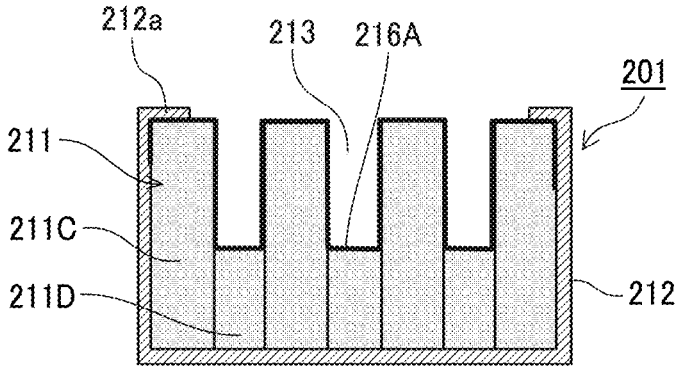
FIG. 37 is a cross-sectional view of a liquid receiver in a twenty-second embodiment of the present disclosure, taken along the short-side direction.

A description is given below of a liquid receiver according to a twenty-second embodiment with reference to FIG. 37. FIG. 37 is a cross-sectional view of the liquid receiver along the short-side direction.

In the present embodiment, the slit width retainer 216 is in contact with not only the top of the absorbing member 211C but also the top of the absorbing member 211D. This structure can prevent the position of the absorbing member 211D from shifting due to the rotation of the liquid receptacle 200.

In the twentieth to the twenty-second embodiments, the number of the slit width retainers 216 arranged in the longitudinal direction of the liquid receiver 201 is not limited to two. When one slit width retainer 216 is used, the slit width retainer 216 is preferably disposed at the center of the liquid receiver 201 in the longitudinal direction. When three or more slit width retainers 216 are used, the intervals between the adjacent slit width retainers 216 in the longitudinal direction of the liquid receiver 201 can be made equal, or the slit width retainers 216 can be disposed not to oppose to the nozzles.

In the present disclosure, the "liquid" discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

The term "liquid discharge head" signifies liquid discharge heads employing, as an energy source to generate energy to discharge liquid, a piezoelectric actuator (a laminated piezoelectric element or a thin-film piezoelectric element), a thermal actuator that employs an electrothermal transducer element, such as a heat element, or an electrostatic actuator including a diaphragm and opposed electrodes.

The term "liquid discharge apparatuses" signifies apparatuses that drive a liquid discharge head to discharge liquid. The liquid discharge apparatus is not limited to an apparatus capable of discharging a liquid to a material to which liquid can adhere but includes an apparatus that discharges a liquid toward gas or into liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

As the liquid discharge apparatuses, for example, there are image forming apparatuses to discharge ink onto sheets to form images and three-dimensional fabricating apparatuses to discharge molding liquid to a powder layer in which powder is molded into a layer-like shape, so as to form three-dimensional fabricated objects.

The "liquid discharge apparatus" is not limited to an apparatus to discharge liquid to visualize meaningful images, such as letters or figures. For example, the liquid discharge apparatus can be an apparatus to form arbitrary images, such as arbitrary patterns, or fabricate three-dimensional images.

The above-mentioned term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

The above-mentioned "material to which liquid adheres" can be any material, such as paper, thread, fiber, cloth, leather, metal, plastic, glass, wood, ceramics, or the like, as long as liquid can temporarily adhere.

The "liquid discharge apparatus" can be an apparatus in which the liquid discharge head and a material to which liquid can adhere move relatively to each other. However, the liquid discharge apparatus is not limited to such an apparatus. For example, the liquid discharge apparatus can be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

Further, as a mode in which the liquid receptacle is relatively moved with respect to the head, the liquid receptacle can be fixed, and the head can be moved with respect to the liquid receptacle.

The terms "image formation," "recording," "printing," "image printing," and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a head configured to discharge a liquid;

a liquid receptacle configured to receive the liquid discharged from the head, the liquid receptacle including:

an absorber including a slit; and an absorber case configured to house the absorber;

a moving device configured to move the liquid receptacle relative to the head; and control circuitry configured to cause the head to discharge the liquid into the slit of the absorber while moving, with the moving device, the liquid receptacle with respect to the head.

2. The liquid discharge apparatus according to claim 1, wherein the absorber includes:

a plurality of first absorbing members; and a plurality of second absorbing members shorter than the plurality of first absorbing members, the plurality of second absorbing members disposed alternately with the plurality of first absorbing members.

3. The liquid discharge apparatus according to claim 1, wherein the absorber includes a plurality of slits including the slit.

4. The liquid discharge apparatus according to claim 3, wherein the control circuitry is configured to:

measure a discharge amount of the liquid to each of the plurality of slits;

cause the head to discharge the liquid to a target slit of the plurality of slits; and change the target slit every time the discharge amount of the liquid to the target slit exceeds a threshold, or every discharge of the liquid to the plurality of slits.

5. The liquid discharge apparatus according to claim 4, wherein the control circuitry is configured to change the target slit in an order from extreme downstream one of the plurality of slits to extreme upstream one of the plurality of slits in a direction in which the liquid receptacle moves relative to the head.

6. The liquid discharge apparatus according to claim 3, wherein the control circuitry is configured to:

cause the head to discharge the liquid to a target slit of the plurality of slits; and change the target slit every time a predetermined time elapses from previous discharge of the liquid to the plurality of slits.

7. The liquid discharge apparatus according to claim 1, wherein the liquid receptacle further includes a slit width retainer configured to maintain a width of the slit.

8. The liquid discharge apparatus according to claim 7, wherein the absorber case includes a bent portion configured to cover a portion of a top of the absorber and sandwich a portion of the slit width retainer together with the top of the absorber.

9. The liquid discharge apparatus according to claim 1, comprising a plurality of liquid receptacles including the liquid receptacle.

10. The liquid discharge apparatus according to claim 9, wherein the control circuitry is configured to measure a discharge amount of the liquid to each of the plurality of liquid receptacles.

11. The liquid discharge apparatus according to claim 1, wherein the moving device includes a plurality of sheet conveyance faces at positions different from the liquid receptacle in a direction in which the liquid receptacle moves relative to the head, the plurality of sheet conveyance faces configured to convey a plurality of sheets to which the head applies the liquid, respectively, and wherein the control circuitry is configured to cause the head to discharge the liquid into the slit of the absorber at a timing when the liquid receptacle faces the head.

12. The liquid discharge apparatus according to claim 1, wherein a width of the slit of the absorber is wider on an entrance side than on a bottom side, the width being a length of the slit in a direction in which the liquid receptacle moves relative to the head.

13. The liquid discharge apparatus according to claim 1, wherein a width of the slit of the absorber is wider on a bottom side than on an entrance side, the width being a length of the slit in a direction in which the liquid receptacle moves relative to the head.

14. The liquid discharge apparatus according to claim 1, wherein the absorber case includes a lid having an opening corresponding to the slit of the absorber.

15. The liquid discharge apparatus according to claim 1, wherein the control circuitry is configured to change a discharge position in the slit, the discharge position to which the head discharges the liquid.

* * * * *